United States Patent [19]

Krajicek et al.

[11] Patent Number: 4,856,545

[45] Date of Patent: Aug. 15, 1989

[54] MULTI-LANGE TUBE BUNDLE CLEANER

[75] Inventors: Richard W. Krajicek, Houston, Tex.; Robert R. Cradeur, Sulphur, La.

[73] Assignee: Serv-Tech, Inc., Houston, Tex.

[21] Appl. No.: 268,338

[22] Filed: Nov. 7, 1988

Related U.S. Application Data

[62] Division of Ser. No. 773,642, Sep. 9, 1985, Pat. No. 4,805,653.

[51] Int. Cl.[4] ..... B08B 3/02

[52] U.S. Cl. ..... 134/166 C; 134/167 R; 134/172; 134/174; 239/165; 239/172

[58] Field of Search ..... 134/166 R, 166 C, 167 R, 134/172, 174, 201; 15/104.1 R; 239/151, 165, 172; 414/728, 718; 901/43

[56] References Cited

U.S. PATENT DOCUMENTS

| | | |
|---|---|---|
| 1,694,371 | 12/1928 | Burdick . |
| 3,074,649 | 1/1963 | Atkinson . |
| 3,153,510 | 10/1964 | Brannfors et al. . |
| 3,163,880 | 1/1965 | Johnson . |
| 3,675,721 | 7/1972 | Davidson et al. . |
| 3,903,912 | 9/1975 | Ice et al. . |
| 3,938,535 | 2/1976 | Cradeur et al. . |
| 4,095,305 | 6/1978 | Goodwin . |
| 4,170,264 | 10/1979 | Gibson . |
| 4,201,342 | 5/1980 | Stram . |
| 4,220,170 | 9/1980 | Hebert et al. . |
| 4,252,274 | 2/1981 | Kubacak . |

FOREIGN PATENT DOCUMENTS

| | | |
|---|---|---|
| 52-36865 | 3/1977 | Japan . |

*Primary Examiner*—Frankie L. Stinson

*Attorney, Agent, or Firm*—Baker, Kirk & Bissex

[57] ABSTRACT

An essentially self-contained mobile tube cleaning machine which is remotely operable so that there is no need for operating personnel to be in close proximity to cleaning nozzles or other high pressure lines during tube cleaning operations. As a consequence, significantly higher water pressures and significantly higher water flow rates can be utilized thereby not only accelerating the rate of cleaning but also the efficiency and the effectiveness of the cleaning operation. Through the provision of a nozzle head at the end of an articulatable boom, it is possible to adjust the location of the nozzle through movement of the boom in order to clean the face of a tube bundle, the shell side of a tube bundle and the interior of the tubes themselves.

10 Claims, 10 Drawing Sheets

MULTI-LANGE TUBE BUNDLE CLEANER

This application is a division of application Ser. No. 773,642, filed Sept. 9, 1985 and now U.S. Pat No. 4,805,653.

BACKGROUND OF THE INVENTION

1. Technical Field of the Invention

This invention relates to a mobile articulatable tube bundle cleaner. More particularly, this invention relates to an essentially self-contained mobile tube bundle cleaner including an articulatable boom carrying a water delivery system connected with a variable speed, high volume, high pressure, positive displacement pump for jetting a high velocity, high volume stream of water from the water delivery system onto a tube bundle to be cleaned. By appropriate articulation of the boom, it is possible to orient the cleaning nozzle in all planes so that the shell side of a tube bundle can be cleaned from top to bottom. The nozzle head can be oriented directly into the bundle face allowing cleaning of the bundle ends and, with a special multi-lance system, can be used to rapidly and effectively clean the insides of the tubes of the tube bundle.

2. Prior Art

It has heretofore been the practice to clean tube bundles using a hand held and manually operated cleaning lance which is connected with a water source and a pump, such as a 150 horsepower diesel powered pump for delivering water through the lance gun at a pressure of about 5000 psi or less at a flow rate of about 10 gallons per minute or less. Since a lance gun of this type is designed to be held and operated manually, human capabilities limit both the pressure and the rate at which water can be delivered to the lance gun. The water line leading to the lance gun is normally equipped with a pressure relief valve and the operator of the gun is provided with a foot controlled actuator for turning water on and off. When the inside of the tubes of a tube bundle are to be cleaned, it is conventional practice to provide a second operator who stands at the face of the tube bundle and manually feeds the water lance into the tube to be cleaned while the operator of the lance gun progressively walks towards the face of the bundle. If, for any reason, such as, for example, the existence of a plug in the tube, the cleaning lance is immobilized and blocked, unless the operator of the lance gun immediately shuts off the water, excessive water pressure can rapidly build up in the line and can cause breakage of the equipment and, all too frequently, physical damage to the operators.

The inherent inefficiencies and limitations of this system are such that the cleaning of tube bundles can only proceed at a comparatively slow rate involving many man-hours of extremely hard physical labor.

SUMMARY OF THE INVENTION

This invention is directed to an essentially self-contained mobile tube cleaning machine which is remotely operable so that there is no need for operating personnel to be in close proximity to cleaning nozzles or other high pressure lines during tube cleaning operations. As a consequence, significantly higher water pressures and significantly higher water flow rates can be utilized with safety thereby not only accelerating the rate of cleaning but also the efficiency and the effectiveness of the cleaning operation. It is possible to adjust the location of the nozzle head at the end of the articulatable boom through movement of the boom in order to clean the face of a tube bundle, the shell side of a tube bundle and the interior of the tubes themselves.

DESCRIPTION OF THE INVENTION

In accordance with the preferred embodiment of the present invention, a diesel powered truck chassis is provided. A diesel motor sized for the operation of an eighteen wheeled tractor-trailer combination, can deliver horsepower of up to about 600 horsepower, which is adequate for the practice of the present invention. In accordance with the present invention, a gear splitter box is provided to interconnect the transmission of the diesel with a water pump drive shaft for a variable speed, high volume, high pressure, positive displacement water pump which is mounted on the chassis of the truck. A boom is also mounted on the truck chassis and appropriate means are provided for rotating the boom horizontally and vertically from an elevation as low as grade level to a maximum height of about 30 feet. In addition, an extensible scope may be mounted on the boom so as to extend the reach for the boom.

The height that the boom can reach is preferably increased by mounting a pedestal on the chassis and mounting the boom on the pedestal. With this construction the water lines comprising the water delivery system lead from the pump through the pedestal and a swivel joint interconnecting the water line with high pressure articulatable hoses so that water can be delivered from the pump to the end of the scope. All of the water lines on the boom and in the scope are enclosed within channeled frame members so that in the unlikely event of a failure of one of the lines, damage to the machine is minimized and the danger of injury to operators is even further minimized. Appropriate nozzle means fitted to the end of the high pressure water lines carried by the boom and scope can be used to direct water under an elevated pressure such as a pressure of about 10,000 psig at flow rates of about 100 gallons per minute or more in the form of at least one stream of water jetting onto a surface of a tube bundle to be cleaned. The impact generated by a water jet of this character is sufficient to dislodge calcareous and/or carbonaceous deposits that have been baked onto a tube bundle without actually damaging the tubes themselves.

In accordance with the preferred embodiment of the present invention the water inlet line for the pump is provided with a fluid displacement water tank so that the pump, while in operation can be operated constantly even though there is discontinuous operation of the nozzle. This is accomplished by providing for a normally closed water recycle line leading from the discharge end of he pump to the water tank; flow through the recycle line being controlled by a valve that can be opened when the flow of water from the nozzle is discontinued.

There are numerous safety features and advantages of the present invention.

There is no need for direct handling of high pressure hoses or fittings by operating personnel in that operating personnel can remotely operate the cleaning device of the present invention well away from blasting nozzles. There are no exposed high pressure hoses on the ground or elsewhere which, on rupture, can cause serious injury to personnel. The mobile cleaning boom can be moved quickly and safely to and from various locations.

Insofar as operations are concerned, a water flow system is provided which is characterized by minimal pressure drop from the pump discharge to the cleaning nozzles. This delivers a maximum cleaning horsepower to the water jet impacting on a surface of the tube bundle to be cleaned.

The nozzle head can be oriented in all directions so that the shell side of the tube bundle can be cleaned from top to bottom and on the sides. Also, the nozzle head can be oriented to directly face the tube bundle allowing cleaning of the bundle ends. This latter feature eliminates the need for hand blasting the ends thereby reducing the danger to operating personnel of the hazards involved in hand blasting and also resulting in a more rapid and efficient cleaning of the ends of the tube bundles.

The articulatable boom provides maneuverability so the nozzle can be directed onto bundles at an elevation, such as an elevation of thirty feet thereby eliminating any need for scaffolding when a bundle is to be cleaned adjacent an elevated location in a plant unit.

The use of various fittings on the nozzle enables cleaning not only of the shell side and faces of the tube bundle but also the interior surfaces of the tubes themselves.

In appropriate situations, tube bundles can be transported from a plant location to a special area where they can be more rapidly and effectively cleaned. Thus, tube bundles can be located around the tube cleaning machine of the present invention for increased speed of cleaning operations.

Flow rates and pressure rates can be constantly maintained. A diesel engine operates best at constant speed and constant load and the control system of the present invention is such that there is no need to vary the engine speed and pressure of the pump regardless of the cleaning function taking place, thereby eliminating frequent shock loading to hoses, fittings, transmissions, pumps, gears and engine.

A particularly desirable feature of the present invention is the provision of a unique multi-lance system for cleaning the inside of more than one tube at a time, in contradistinction to the prior art practice of cleaning one tube at a time. In accordance with this embodiment, an elongate frame is provided with a plurality of tubular cleaning lances housed longitudinally on the frame for alignment with a corresponding number of tubes in the tube bundle. The tube cleaning lances are laterally movable through the lance housing so that they can then be effectively moved into and out of the tubes with a force of up to 1000 pounds of thrust in addition to the force exerted by the water jetting from the head of the lance thereby providing a means for positively breaking through plugs of the tube and resulting in a more efficient cleaning action.

The elongate frame is carried by a suitable movable support means such as a dolly, a crane or, preferably, the boom of the mobile tube bundle cleaner of the present invention. The cleaning lances are connected with a suitable water source, such as a high velocity high volume positive displacement pump which is preferably, but not necessarily, the high velocity, high volume, positive displacement pump mounted on the truck chassis of the mobile tube bundle cleaner of the present invention. Thus, if desired, the multi-lance tube cleaning system may be mounted and operated separately from the mobile tube bundle cleaner of the present invention. However, the multi-lance cleaning system preferably is integrated with and operated as an integral part of the mobile tube bundle cleaner of the present invention, as shown and described herein.

DESCRIPTION OF THE DRAWINGS

The invention will be further illustrated in connection with the attached drawings wherein:

FIG. 20 is a fragmentary perspective view to an enlarged scale of the control panel shown schematically in FIGS. 11–13 showing a preferred manner in which the electrical system of FIG. 16 may be operated.

DETAILED DESCRIPTION

Figure 1:
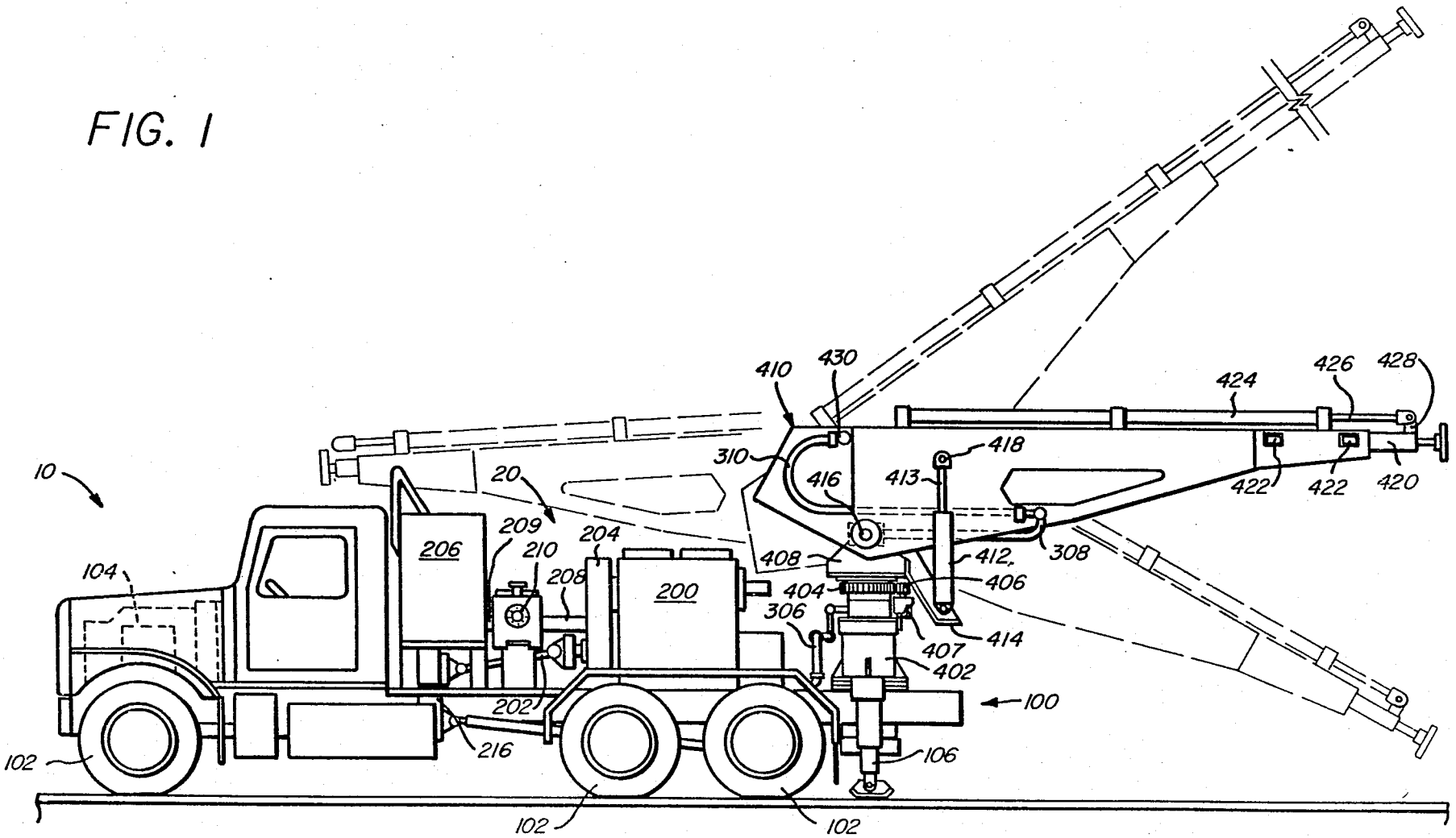
FIG. 1 is a side elevational assembly view of a preferred embodiment of the self-contained mobile tube bundle cleaner of the present invention showing the parts in several working relationships in dotted line.

In the drawings, in the interest of clarifying the disclosure, conventional parts such as nuts, bolts, screws, welds, unions, junctions, valves, etc., which are constructed and operated in their normal intended manner have not been shown since these are matters within the skill of the art.

Turning now to FIG. 1, there is shown a mobile base of any suitable construction designated generally by the numeral 10 such as a conventional truck chassis 100 (e.g., the nine wheel chassis of a tractor-trailer combination) appropriately mounted on traction means such as tractor treads, skids or, more preferably, wheels 102 for movement and carrying a suitable power source such as an internal combustion engine (e.g., diesel engine 104) of any conventional construction. Stabilizing means such as a pair of hydraulically powered stabilizing jacks 106—106 are mounted to the chassis 100 at the rear end thereof to stabilize the truck chassis 100 against movement when the tube bundle cleaner 10 of the present invention is at a desired location.

Water pressuring means such as a variable speed, high volume, high pressure, positive displacement pump 200 is mounted on the chassis 100. Power transmission means of any suitable construction are provided for powering the water pressuring means. In accordance with a preferred embodiment of the present invention, the transmission of the truck (not shown) is operatively connected with a gear splitter box 216 which powers a pump drive shaft 202 which, in turn, is operatively connected with a drive chain 204. The drive chain 204, in turn, is connected with the drive shaft (not shown) for the pump 200.

Water supply means interconnected with the water pressuring means are provided for the delivery of water thereto. The water supply means may be of a conventional construction but, in accordance with the preferred embodiment of the present invention shown in the drawings, will be interconnected with the pressured water delivery means (to be described) in order to permit periodic recycle while the water pressuring means is in operation. Thus, for example, in accordance with the present invention, a water tank 206 open to the atmosphere is mounted on the chassis 100, preferably adjacent the cab of the truck. Water channeled through a pipe (not shown) from an extraneous source is connected to the unit 10 at water inlet junction 210 mounted on the chassis 100 and from thence through a water inlet line 209 to water tank 206. As shown more clearly in FIG. 1A, water line 208 leads from the water tank 206 to the suction side of the pump 200. Water under pressure is delivered from the pump 200 to a pump discharge line 300 containing a normally open main valve 304 which may suitably be a pneumatically powered remotely controlled shut-off valve of any conventional construction. A water recycle line 302 containing a normally closed recycle valve 303 (which may suitably be a pneumatically powered remotely controlled adjustable valve of any conventional construction), branches from the pump discharge line 300 to recycle water to the water tank 206 in a manner and for a purpose to be later described.

Returning now to FIG. 1, the water pressuring means deliver water at a predetermined pressure and volume to pressured water delivery means of any appropriate construction which will comprise, for example, an assembly of several connected pipes and reinforced flexible high pressure hoses adapted to the specific construction of the articulatable support means (to be described) for pressured flow of water to the water discharge means (to be described).

Figure 1A:
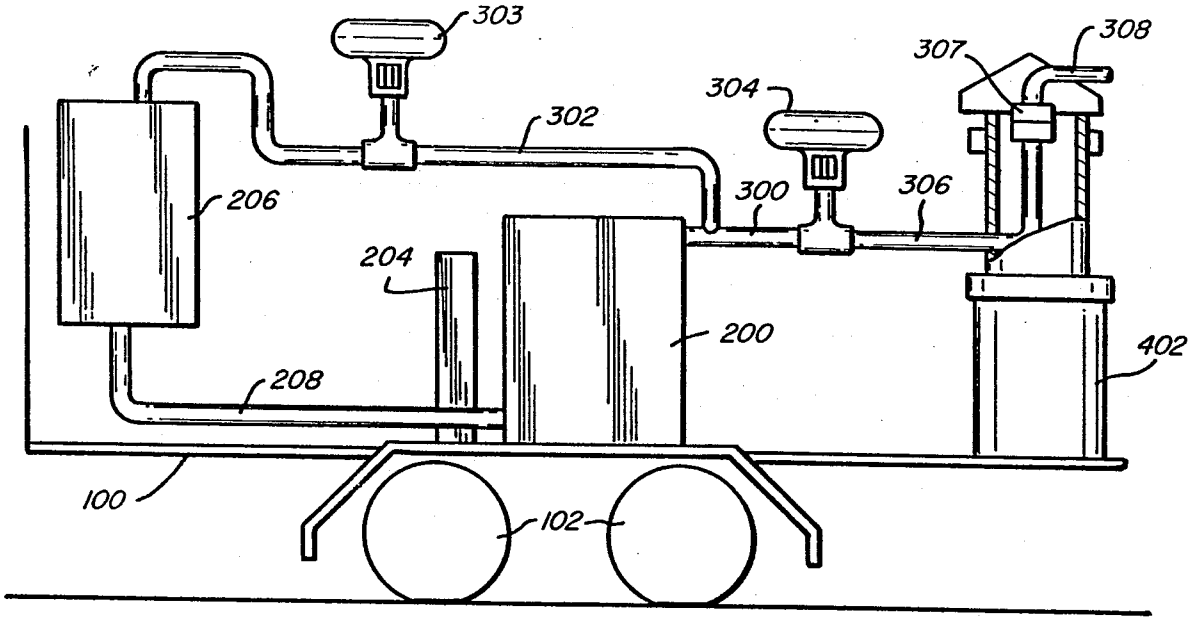
FIG. 1A is a fragmentary side elevation view to an enlarged scale of the obverse side of the assembly shown in FIG. 1.
Figure 3:
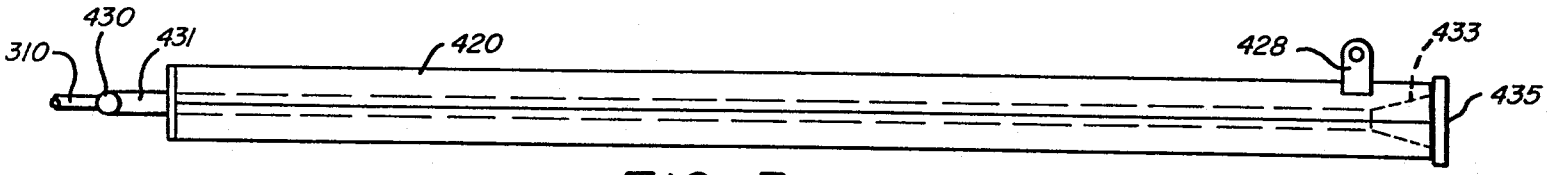
FIG. 3 is a side elevational view of the scope which comprises an element of the preferred embodiment of the present invention.
Figure 3A:
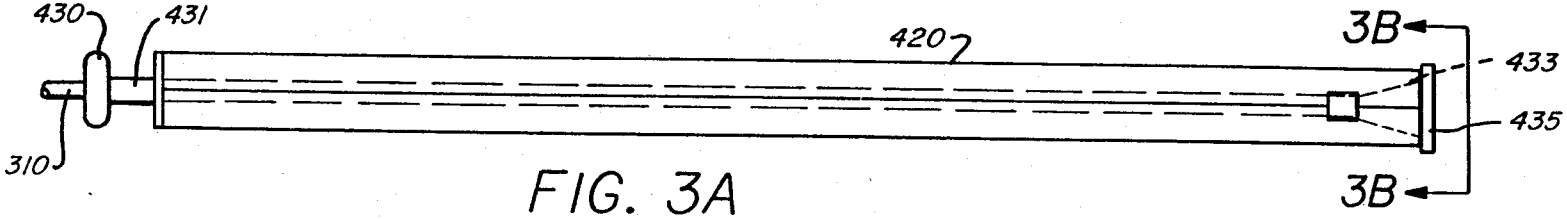
FIG. 3A is a top view of the scope shown in FIG. 3.

As more clearly, schematically shown in FIG. 1A, in accordance with the illustrated preferred embodiment of the present invention, the pump discharge line 300 leads to the boom delivery pipe 306 which, in turn, leads through the interior of the pedestal 402 to a swivel valve 307 of any suitable conventional construction leading to the boom pipe 308.

The support means for the water delivery means should be articulatable for both vertical and horizontal movement and should comprise channels for carrying the tubular members comprising the water delivery means in order to provide support, where necessary, but more importantly, as a safety measure to minimize damage to equipment in the event of a rupture and to minimize the risk of injury to operating personnel. Horizontal and vertical articulation are conveniently provided through the provision of a boom horizontally rotatably mounted on the chassis 100 and through the provision of appropriate means, such as rack and pinion gears, hydraulic pistons, etc., carried by the boom in order to provide for vertical movement thereof. Although the boom may be mounted directly on the chassis 100, and in order to increase the height to which the boom may be raised, in accordance with a preferred embodiment of the present invention, a pedestal is mounted on the chassis 100 and the boom is mounted on the pedestal. As shown more clearly. in FIG. 1, in accordance with the preferred embodiment a cylindrical boom pedestal 402 is mounted on the chassis 100, a rotating boom gear 404 is mounted on the boom pedestal 402 in engagement with a power driven pinion gear 406 for rotating the boom 410 in a horizontal direction. The pinion gear 406 is powered by a hydraulic motor 407 which is also mounted on the boom 402. A boom support 408 is mounted on the boom gear 404.

Figure 2:
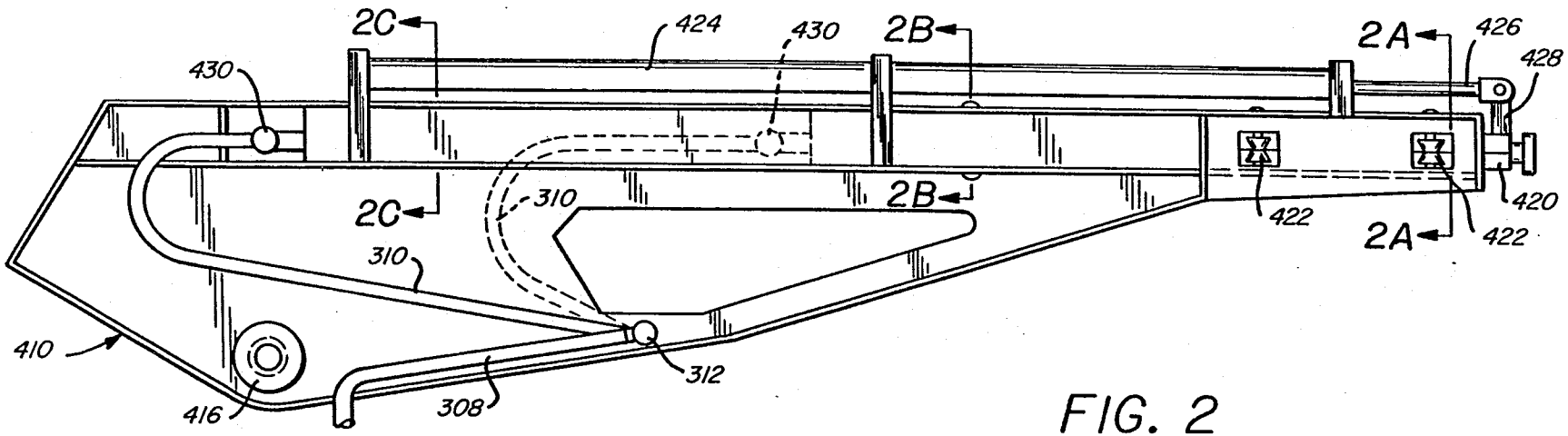
FIG. 2 is a side elevational view of the boom which comprises an element of the preferred embodiment of the present invention with parts broken away.
Figure 2D:
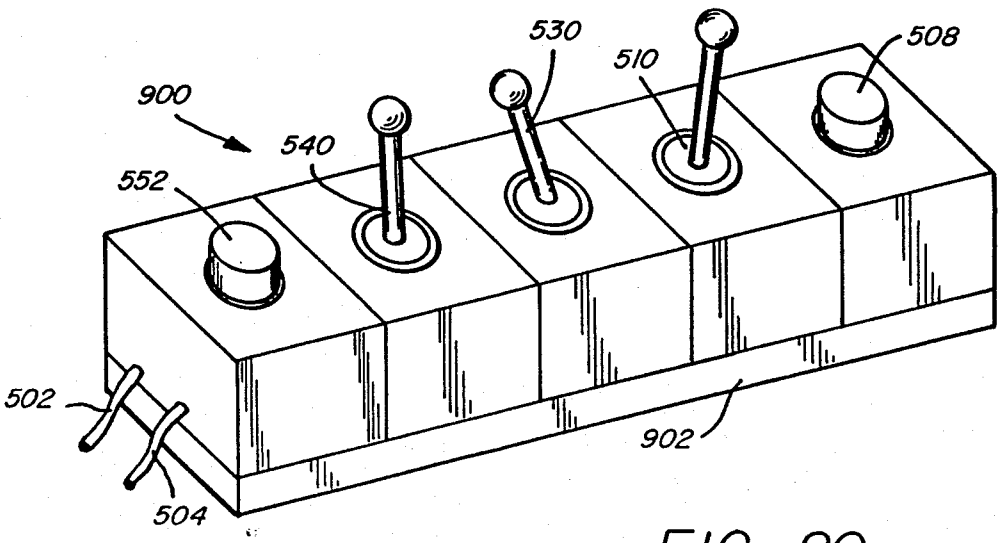
FIG. 2A is a fragmentary sectional view taken along the lines 2A—2A of FIG. 2.
FIG. 2B is a fragmentary sectional view taken along the line 2B—2B of FIG. 2.
FIG. 2C is a fragmentary sectional view taken along the line 2C—2C of FIG. 2.
Figure 2C:
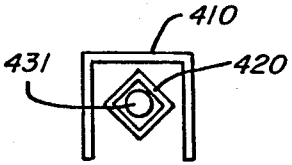
Figure 2A:
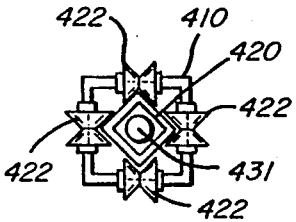
Figure 2B:
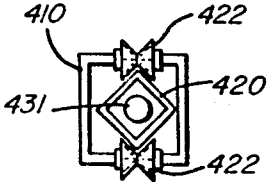

Turning now to FIGS. 1, 2 and 2A, it will be seen that a channelled boom 410 is rotatably supported on the boom support 408 by means of a boom trunion 416 which carries a boom cylinder support 414 to which boom height hydraulic cylinder 412 is mounted at the lower end thereof. A boom height control piston 417 interconnects with a pivotal boom piston support 418 mounted on the channelled boom 410.

If desired, the support means may consist essentially of a boom, such as the boom 410, the water delivery means may be terminated at the end of the boom 410 and the water discharge means (to be described) may be interconnected with the water delivery means at the end of the boom 410. However, in order to increase the lateral reach of the tube bundle cleaner and to increase the vertical height that can be reached with the water delivery means, in accordance with the preferred embodiment of the present invention, scope means are provided at the end of the boom 410 for carrying an extension of the water delivery means. The scope means can be of a known general construction comprising, for example, one or more pieces of pipe of the same or varying length (not shown) that can be bolted or threaded to the end of the boom 410 in a conventional manner. The provision of a scope means of this nature suffers from the disadvantage of using exposed pipe, with the attendant added risk of injury to the equipment and operators in the event of a rupture or break. Also, tube cleaning operations must be interrupted each time a pipe is to be connected or disconnected. The safety problem can be partially overcome by encasing the pipes in an elongate housing (not shown), but this would add still more weight at the end of the boom and would require the use of counter balance means (not shown) in order to stabilize the structure.

It has been discovered in accordance with the present invention that the advantages to be obtained through the provision of a scope means can be attained without suffering disadvantages, such as those just mentioned, through the provision of a channeled scope means 420 mounted on the top of the channelled boom 410. As is seen more clearly in FIGS. 1, 2, 2A, 2B, 2C, 3 and 3A, the channeled scope 420 is suitably rectangular in shape and is supported at its forward end by rollers 422 so that actuation of a scope cylinder 424 will cause extension of scope extender piston 426 to thereby extend the scope 420. The scope extender piston 426 is interconnected at its forward end to the scope 420 by an adapter bar 428. In accordance with this construction, it is necessary to provide one or more reinforced, flexible high pressure hoses. Reinforced, flexible hoses capable of withstanding an internal pressure of about 10,000 psig. or more are flexible (i.e., bundable) only within comparatively narrow limits so that the minimum safe radius of curvature increases exponentially with the thickness and diameter of the hose. Therefore, in order to maintain reasonable dimensions for the channeled boom, a plurality of reinforced high pressure hoses (e.g., four hoses) having an outer diameter of about 4 inches are used to transfer water from the boom hose 308 to the scope 420. In accordance with this construction, a boom hose manifold 312 is provided at the end of boom hose 308 similar in construction to a water manifold 430 at the rear end of the channeled scope 420 and the manifolds 312 and 430 are fluidly interconnected with a plurality of reinforced, flexible high pressure hoses 310 (only one of which is shown in the drawings).

Figure 3B:
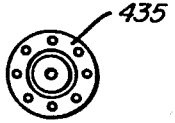
FIG. 3B is a fragmentary front view taken along the lines 3B—3B of FIG. 3A.

The water manifold 430 receives water under pressure from boom hose 310 and delivers it to a scope conduit 431 housed in the scope 420 and extending therethrough for interconnection with a scope discharge port 433 provided with a flanged end plate 435. This is shown more clearly in FIGS. 3, 3A and 3B.

Figure 17:
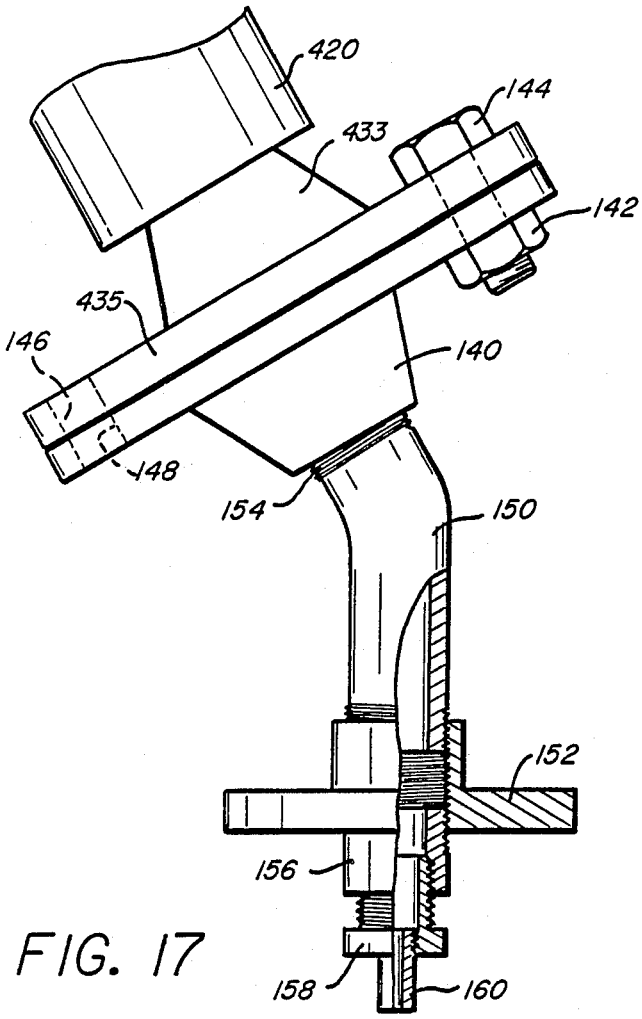
FIG. 17 is a fragmentary view, to an enlarged scale, of one type of nozzle that may be used in the practice of the present invention.
Figure 19:
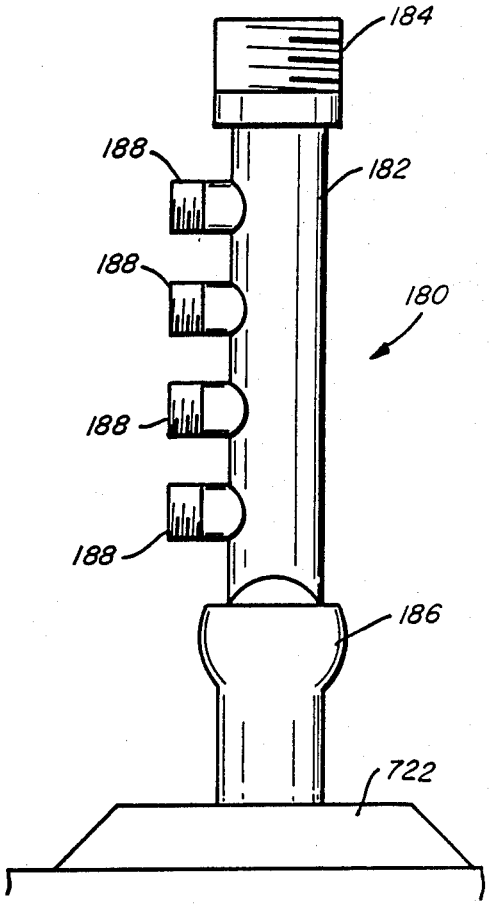
FIG. 19 is a fragmentary view to an enlarged scale of yet a third type of nozzle that may be used in the practice of the present invention.
Figure 18:
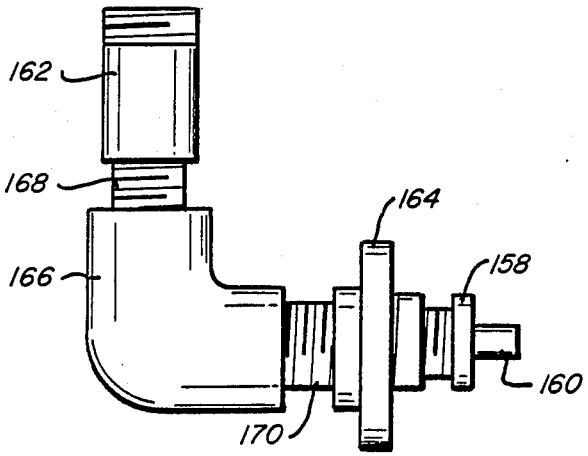
FIG. 18 is a fragmentary view, to an enlarged scale, of another type of nozzle that may be used in the practice of the present invention.

The water discharge means to be connected to the outlet of the water delivery means may be of any suitable construction and may comprise a nozzle or a plurality of nozzles of different construction for use in different situations. Turning next to FIGS. 17, 18 and 19, a few of the many types of nozzles that can be used are shown by way of example and illustration. For example, when the tube bundle cleaner 10 of the present invention is to be utilized to clean the shell side (outside) of a tube bundle, an appropriate nozzle assembly may be fitted to the end plate 435, as shown, for example, in FIG. 17. In accordance with this embodiment, a flanged nozzle adapter 140 is secured to the face of flanged end plate 435 by any suitable means, such as, for example, by means of nuts 142 secured to bolts 144 passing through aligned bolt holes 146–148 in the flanges of the end plate 435 and the nozzle adapter 140. A tubular connector 150, provided at the free end thereof with, for example, the spoked member 152 of a hammer-nut union is fixed to the nozzle adapter 140 (e.g., by external threads 154). It will be observed that the tubular connector 150 is angled (e.g., at an angle of about 100°–115°) from the axis of the scope 420. This is a desirable feature because the scope 420 will normally be at an acute angle from the horizontal when it is extended and positioned for tube bundle cleaning operations. With this construction, the free end of the tubular connector will be in an essentially vertical position while in use.

A hammer union mate 156 is securely threaded to the spoked member 152 and an exteriorly threaded plug 158 is, in turn, secured to the hammer union mate 156. The plug 158 is provided with one or more circular openings into which water jet tips 160 may be secured. For example, if the fouling deposits on the shell side of the tube bundle are comparatively soft and are selectively easy to remove, two or three of the water jet tips 160 may be used, while only one will be used if the fouling deposits are of a more refractory nature.

If the face of a tube bundle is to be cleaned, the hammer union mate 156 may be removed from the spoked member 152 and, with reference to FIG. 18, an elongate hammer union mate 162 may be fixed thereto. The elongate mate 162 is connected with a second spoked hammer union member 164 by any suitable means, such as an elbow joint 166 secured to the elongate mate 162 and the second spoked hammer union member 164 may be exteriorly threaded connections 168 and 170. A second hammer union mate 172 can then be secured to the second spoked hammer member 164 and a plug 158 equipped with a water jet tip 170 can be secured to the second hammer union mate 172 so that water can be jetted into the end plate of a tube bundle in a horizontal direction.

In order to clean the inside of a tube in a tube bundle, it is necessary to use a cleaning lance of the type known to those skilled in the art. A cleaning lance will comprise an elongate tube, preferably made from high strength steel, having a diameter less than the diameter of a tube to be cleaned and provided with means, such as threads, for interconnection with a water supply source at one end and with a nozzle, such as an onion shaped ball nozzle at the other end. The cap is drilled about the periphery thereof with a plurality of orifices facing forwardly, laterally and rearwardly of the path of travel of the lance so that carbonaceous and/or calcareous deposits loosened by the forwardly-directed orifices are dislodged and swept past the cap for flow from the tube being cleaned. However, if for any reason, such as lodgment of the cap in a comparatively soft plug of fouling deposits, the flow of water through some or all of the orifices is interrupted, a rapid and dangerous build-up of hydrostatic pressure will occur that can rupture the lance and injure the operator. There is a long-felt need for the provision of a means for eliminating the slow, dangerous and inefficient one-tube-at-a-time cleaning technique that is conventionally used. However, this has been a problem for which an easy solution has not been forthcoming. For example, the use of more than one lance tends to increase, rather than decrease the hazardous nature of this operation because the possibility of the blocking of nozzles is increased. Also, if the water pressure in one lance is different from the water pressure in another lance, the lances will clean at different rates. Moreover, the steel tubing of a water lance tends to sag, and the problem of sagging increases as the length of the water lance increases.

In accordance with the present invention a novel and unique multi-lance cleaning system is provided which solves the foregoing and other problems associated with using a plurality of water lances to simultaneously clean a plurality of tubes in a tube bundle.

Figure 7:
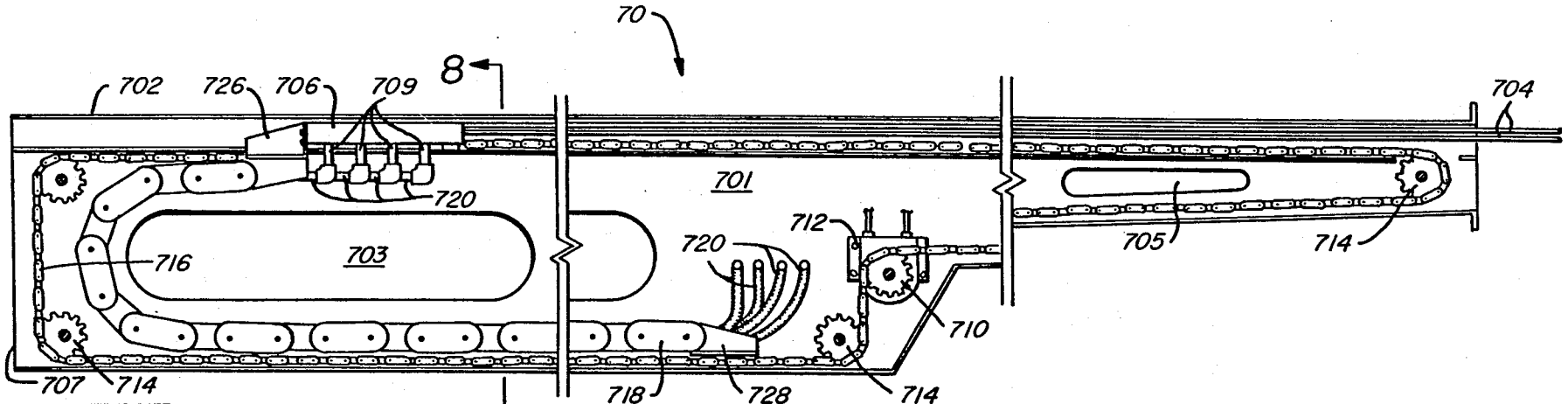
FIG. 7 is a side elevational view with parts broken away, of the multi-lance cleaning system of the present invention.

Turning now to FIGS. 7–10, there is shown a multi-lance tube cleaning system of the present invention designated generally by the number 70. With particular reference to FIG. 7, it will be seen that the multi-lance tube cleaning system 700 comprises an elongate frame 740 which is channeled so as to define a chamber 701. As is shown more clearly in FIG. 8, the elongate frame assembly 740 is provided with a slot 708 which extends the substantial length of the frame 700. The rear of the elongate frame 740 is closed with a rear end plate 707. It will be noticed that the depth of the frame 740 ,adjacent the rear end thereof is significantly greater than the depth adjacent the front end thus, roughly, dividing the chamber 740 into a stock segment 703 and a barrel segment 705. A hydraulic motor 712 is mounted to the frame 740 in the stock segment 703 of the chamber 701 adjacent the front end thereof and a power gear 710 is fixed to the hydraulic motor 710. A plurality of idler gears 714 are mounted in the chamber 701 of the elongate frame assembly 740 adjacent the front end thereof and the back end thereof to provide a guide means for an endless chain 716 which is connected at the front end thereof to manifold means 706 and at the rear end thereof to moveable drag chain mount 726. The manifold means 706 which may suitably be a rectangular block of stainless steel is movably mounted in a lance housing 702. A plurality (e.g., four) of hoses 720 capable of carrying water at a pressure of 10,000 to 15,000 pounds per square inch feed to the manifold means 706 through a plurality of feed pipes 709.

Figure 10:
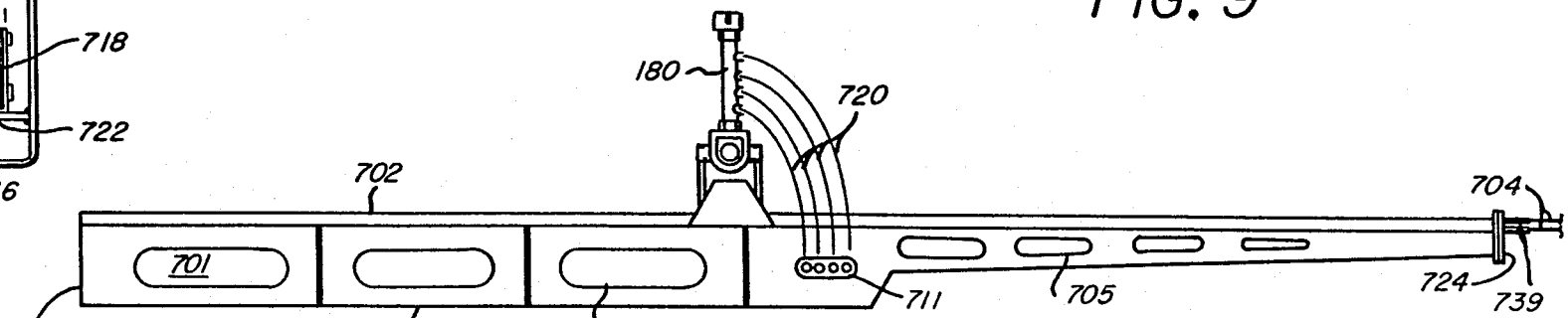
FIG. 10 is a schematic side elevational view of the multi-lance system of the present invention showing the manner in which it may be used in cooperation with the mobile tube bundle cleaner shown in FIG. 1.

As is more clearly shown in FIG. 10, the hoses 720 are suitably connected to the nipples 188 of a manifold 180 and enter the front end of the stock segment 703 of the elongate frame 740 through forward side opening 711.

The construction of a suitable manifold 180 is shown more clearly in FIG. 19. In accordance with this embodiment, the manifold 180 is, in essence, a tubular pipe 182 having a third hammer union mate 184 fixed to one end thereof and adapted to be secured to the spoked hammer union member 152 which is secured by way of tubular connector 150 and nozzle adapter 140 to the flanged end plate 435 at the end of scope 420 (see FIG. 17). As shown in FIG. 10, and more clearly in FIG. 19, the other end of the tubular pipe 182 is fitted to a universal joint 186 which, in turn, is secured to a support flange 722 mounted on lance housing 702. Nipples 188 are secured to the tubular pipe 182 along the length thereof; the nipples 188 preferably being of a design such that the hoses 720 can be connected thereto with quick connect-disconnect couplings.

The hoses 720 are nested in a suitable means such as a drag chain 718 which is fixed to the elongate frame 740 by fixed drag chain mount 728 and pass along the drag chain 718 to feed pipes 709 leading to the manifold means 706. The drag chain 718 is mounted to the manifold means 706 by a movable drag chain mount 726 which extends through the slot 708 at the top of the elongate frame assembly 740.

Figure 9:
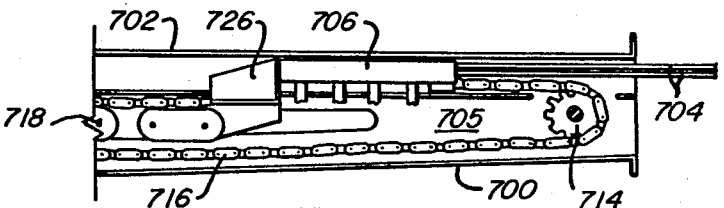
FIG. 9 is a fragmentary side view of a portion of the multi-lance system showing the operative parts in a different position.
Figure 8:
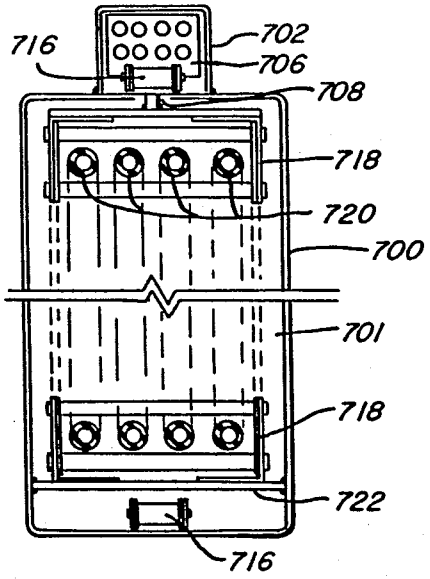
FIG. 8 is a sectional view taken along the lines 8—8 of FIG. 7.

Drag chains are known articles of commerce used to carry hoses and other conduits that move forwardly and backwardly along a linear path of travel. The hoses and lines, being nested in the drag chain, as shown in FIGS. 7, 8 and 9, are thus protected from injury from outside forces and protect equipment and operators outside of the drag chain from injury in the event one of the conduits ruptures. An advantage of a drag chain is that the radius of curvature of the links of the chain can be controlled with precision and, therefore, items such as high pressure water hoses that can be safely arched within prescribed radii of curvature can be cradled in the drag chain for safe and effective use. As an example, the safe radius of curvature of a high pressure water hose is a function of the outer diameter and wall thickness of the hose. In general, the smaller the diameter of the hose, the smaller the radius of curvature. Advantage is taken of this feature in the practice of the present invention. Thus, in the multi-lance tube cleaning system 70 of the present invention, a plurality of small-diameter, high pressure water hoses are connected in parallel with the pipe 180 (FIG. 10) and the manifold means 706 (FIG. 7) so that a drag chain having a comparatively small radius of curvature can be used. As a consequence the bulk of the multi-lance tube cleaning system 70 can be reduced significantly from the bulk that would be required if a single high pressure water hose and a larger drag chain having a significantly larger radius of curvature were used. It will be understood, however, that one or two, three, four or more high pressure water hoses connected in parallel can be used, as desired, with essentially equivalent results insofar as effective tube cleaning is concerned.

Thus, it will be apparent to those skilled in the art that the depth of the stock segment 703 is primarily determined by the angle of curvature of the drag chain 718 which, in turn, in accordance with conventional practice, will be set to conform to the design radius of curvature for the water hoses 720.

A plurality of tube cleaning lances 704 are mounted in the channeled lance housing 702, being fixed at their rear ends to the manifold means 706 and extending outwardly from the elongate frame 740 at their cleaning ends.

As is shown more clearly in FIGS. 9 and 10, the front end of the elongate frame 740 is preferably closed with a lance guide plate 724 provided with openings through which the lances 704 can pass. Still more preferably, a relatively short guide tube 730 will surround each of the openings in the lance guide plate 724.

The heads of the cleaning lances 704 and the guide tubes 730 will be spaced from each other in a spacing pattern which is the same as the spacing pattern of the tubes to be cleaned. If the spacing pattern of the tubes to be cleaned differs significantly from the spacing pattern of the tubes 730, the lance guide plate 724 may be replaced with a different lance guide plate (not shown) having a different, needed pattern. If there are only minor differences in alignment between the alignment of the tubes 730 in end plate 724 and the tubes to be cleaned, a rectangular template (not shown) having holes therein with the same spacing pattern as the tubes to be cleaned, may be urged over the outer ends of the tubes 730 to thereby conform their spacing pattern to the spacing pattern of the tubes to be cleaned.

It is to observed at this point that the manifold 706 in this operation performs a plurality of functions. The tapped interior of the manifold 706 acts as a reservoir for water fed thereto through the lines 720 and the feed pipe 709, and as a pressure equalizer so that equal pressure is maintained and the water flowing through each of the lances 704. Thus, for example, if the nozzle of one of the cleaning lances 704 should become blocked while inside a tube of a tube bundle, the pressure on that lance will instantly and automatically be adjusted to the hydrostatic pressure in the manifold 706, thus preventing the type of disastrous pressure build-up in cleaning lances that has heretofore plagued the tube bundle cleaning industry.

Manifold 206 also serves as a rear support for the lances 704, and as a support for the forward end of the drag chain 718 encasing the water hoses 720 and, finally, by virtue of drag chain mount 726, as a guide for the drag chain as the lances are progressively extended into a tube bundle.

As will be apparent from the foregoing, the multi-lance tube cleaning assembly 70 is preferably used as an integral part of the articulatable tube bundle cleaner 10 of the present invention in the interest of economy and simplicity of operations. However, if desired the multi-lance tube cleaning assembly 70 can be operated as a separate unit, being independently supported on a suitable base such as a mobile crane, a wheeled tractor, skids, etc. (not shown), and independently supplied with water from an independent water delivery system comprising a separate pump (not shown) mounted on the same or a different movable base and independently supplied with power from a separate source (not shown) such as an internal combustion engine, in order to deliver a high volume, high pressure stream of water on demand. In this instance, controls (not shown) similar to those shown in FIG. 15 and FIG. 16 would be independently provided and would not be integrated into a remote control panel 900 such as the panel shown in FIG. 21. It would be possible, however, with such a construction to clean the interior of the tubes of a tube bundle at a location different from the location for cleaning the shell side of the tube bundle or at a different time or from a different extraneous water source.

The construction and operation of the tube bundle cleaner has been defined with reference to the adapters of FIGS. 17, 18 and 19 that can be fitted to the flanged end plate 45 of the scope 420. However, in accordance with another embodiment of the present invention, articulation of the cleaning nozzles is augmented through the provision of articulatable head aligning means such as, for example, the articulatable head aligning means 800 shown in FIGS. 4, 5 and 6.

This embodiment of the present invention is particularly useful when a tube bundle is to be cleaned on-site. For example, the exterior surfaces of the tubes of a tube bundle may not require cleaning, although there is appreciable fouling of the interior of the tube. In such a situation, there is no need to remove the tube bundle from its shell if it can be cleaned in place. This can be accomplished in accordance with the present invention by using the mobile base 10 to maneuver the articulatable tube bundle cleaner to an appropriate location adjacent the tube bundle to be cleaned, attaching the multi-lance tube cleaning system 700 to the flanged end plate 435 as shown in FIG. 10 and FIG. 19 and then adjusting the position of the boom 410 and the scope 420 adjacent the face of the tube bundle to be cleaned and then using the head adjusting means 800 for accurately positioning the multi-lance tube cleaning system 700 in alignment with the tubes of the tube bundle to be cleaned.

This can be important because the consolidation of equipment within a plant can severely restrict access to specific items of equipment in the plant.

Figure 4:
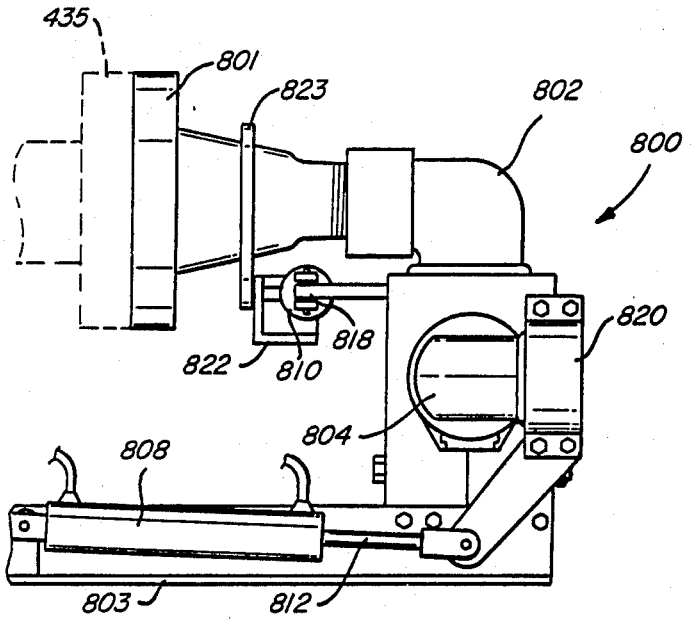
FIG. 4 is a side elevational view of a preferred embodiment of an articulatable head aligning means to be used in accordance with the present invention.
Figure 5:
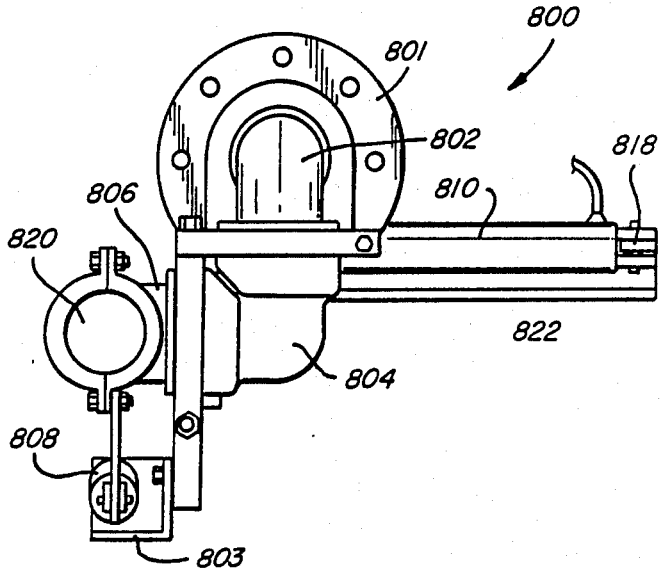
FIG. 5 is a front view of the head shown in FIG. 4.
Figure 6:
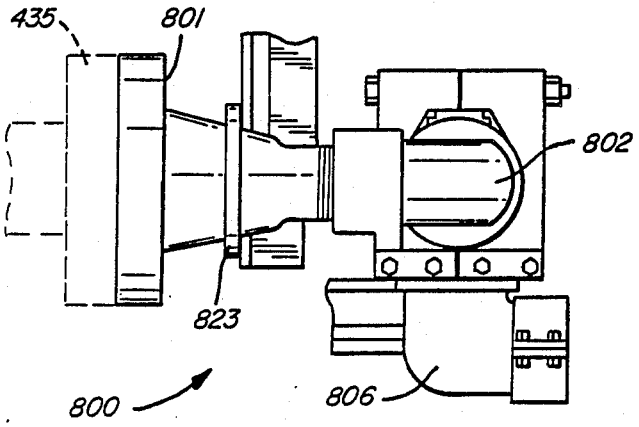
FIG. 6 is a top view of the head shown in FIG. 4.

In accordance with this embodiment, the water delivery means may again terminate with the end plate 435 at the end of scope 420. However, in order to increase the utility and flexibility of the tube bundle cleaner 10, a novel, fully articulatable head means is preferably provided for interconnection with the end plate 435. Turning now to FIGS. 4, 5 and 6, there is shown an articulatable head aligning means 800 comprising a flanged inlet port 801 which can be bolted to the flanged end plate 435, an inlet elbow joint 802, a swivel joint 804 and an outlet elbow joint 806 which are serially interconnected. Outlet elbow joint 806 is interiorly threaded, for a purpose to be described. Vertical articulation of the articulatable head means 800 is provided by vertical head cylinder 808 appropriately supported on a flanged angle bracket 803 by means of vertical pivot 814. A vertical piston rod 812 extends from the piston 808 and interconnects with the elbow joint 806 by means of a pipe clamp 820. Horizontal articulation is obtained through the provision of a horizontal cylinder 810 which is mounted to the articulatable head means 800 by a flanged brace 822 fixed to the flanged inlet port 801 by means of a support ring 823. A horizontal pivot 818 interconnects with horizontal piston rod 814.

Figure 15:
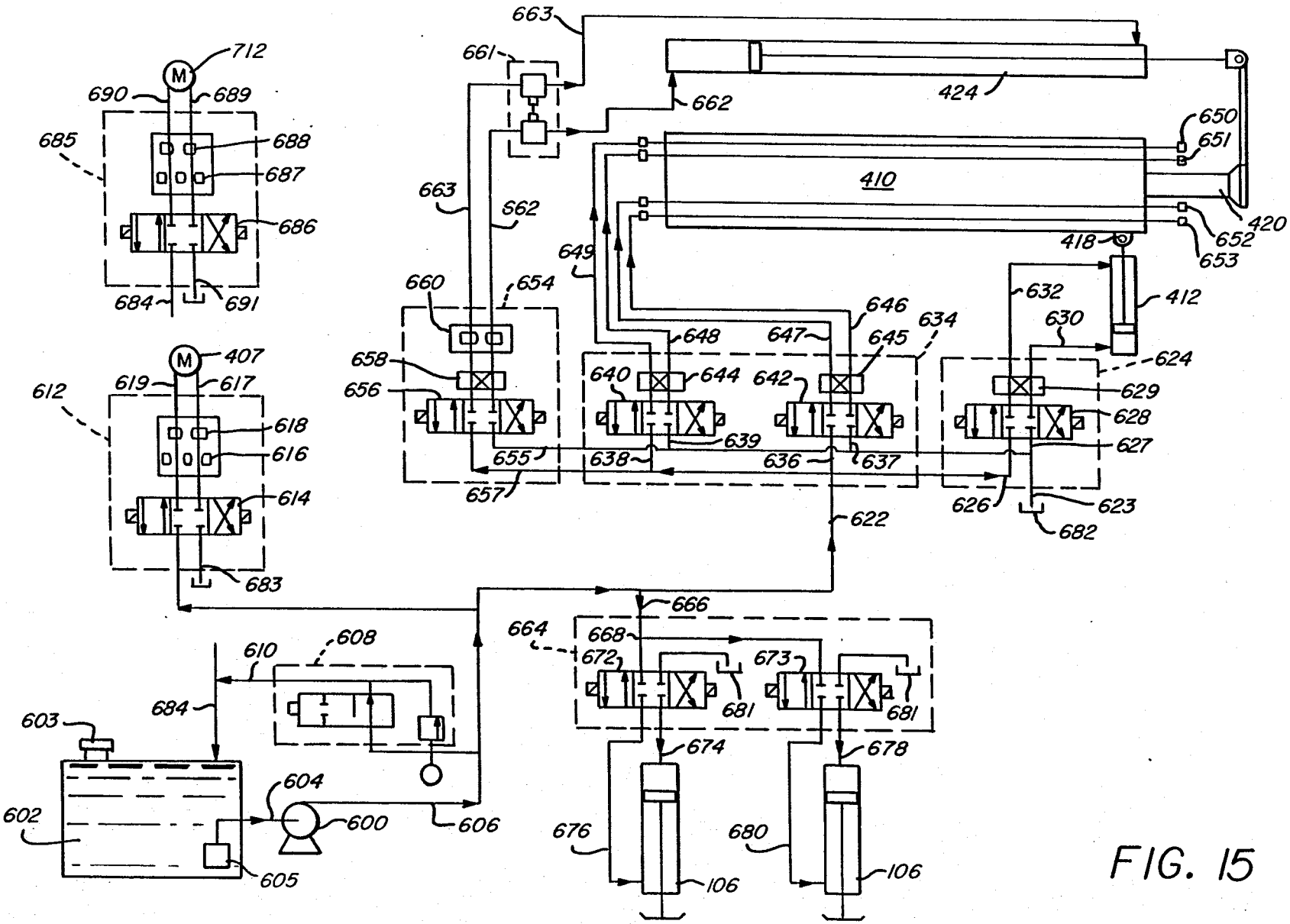
FIG. 15 is a schematic layout of the hydraulic system of the preferred embodiment of the present invention.

Turning now to FIG. 15, there is schematically shown a layout of the hydraulic system that is used in accordance with the present invention showing the interrelationship of the principle components thereof. Conventional components such as pressure relief valves, sight gauges, pressure guages, etc., are not shown since the location, construction and utilization of such components are known to those skilled in the art.

In accordance with the preferred embodiment of the present invention, a reservoir 602 is provided to which hydraulic fluid can be added as needed through fill cap 603. Hydraulic fluid is withdrawn from the tank 602 through a filter 605 and a pump inlet hydraulic line 604 leading to a hydraulic pump 600. Hydraulic fluid is discharged by the hydraulic pump 600 through the hydraulic pump outlet line 606 which is connected in series with a solenoid operated relief valve 608 provided with a relief valve recycle line 610 leading to a tank inlet line 684 by way of which hydraulic fluid can be returned to the tank 602.

Pump outlet line 606 leads to a pedestal manifold designated generally by the numeral 612 containing a solenoid operated pedestal gear control valve 614 connected in series with a restrictor valve 616 with reverse free flow and a relieving sandwich valve 618. A right rotational pedestal gear hydraulic line 617 leads from the relieving sandwich valve 618 to a hydraulic motor 407 utilized to operate boom gear 404 (FIG. 1). A pedestal gear left rotation hydraulic 619 also leads to the hydraulic motor 407.

Hydraulic branch line 622 branching from pump outlet hydraulic line 606 leads in series to a plurality of manifolds. Thus there may be provided a boom manifold designated generally by the numeral 624 containing a boom manifold four-way three-position operating control valve which is fed by hydraulic boom inlet lines 626 and 627. Hydraulic fluid flows through a boom manifold four-way three-position operating control valve 628 and through a boom manifold dual restrictor valve with reverse free flow 629. A boom up hydraulic line 630 leads from the valve 629 to the hydraulic boom cylinder 412 (FIG. 1) for raising the boom 410 and a boom down hydraulic line 632 leads to the piston rod side of the piston 412 for lowering the boom 410.

There may also be provided an articulate head manifold designated generally by the numeral 634 fed by articulate head manifold inlet lines 636, 637, 638 and 639 leading to a pair of multi-lance four-way three-position operating valves 640–642. A pair of dual restrictor valves with reverse free flow 644–645 are connected in series with the operating valves 640–642 and articulate head hydraulic lines 646, 647, 648 and 649 lead from dual restrictor valves 644 and 645 to the boom 410, and thence through the boom 410 and scope 420 (FIG. 1) terminating in articulate head quick disconnect outlet line nipples 650, 651, 652 and 653, respectively.

There may also be provided a scope manifold 654 fed by scope manifold hydraulic inlet lines 655 and 657 leading to a scope four-way three-position operating valve 656. The valve 656 is connected in series with a scope dual restrictor valve with reverse free flow 658, and a scope dual reducing valve with dual reducing-/relieving sandwich valve 660. A scope out hydraulic line 662 leads from the valve 660 through a counterbalancing valve 661 to the scope cylinder 424. In like manner a scope in hydraulic line 663 leads from the valve 660 through the counterbalancing valve 661 piston side of scope cylinder 424.

There may also be provided a manifold 664 for hydraulic jacks 106—106 (FIG. 1). The manifold 664 will suitably be fed by a hydraulic branch line 666 leading from pump outlet line 606. Line 668 leads from line 666 to a first four-way three-position operating valve 672. Line 666 also leads to a second four-way three-position operating valve 673. A left jack down hydraulic line 674 leads from the operating valve 672 as does a left jack up hydraulic line 676. In like manner, a right jack down hydraulic line 678 leads from the operating valve 673 as does a right jack up hydraulic line 680.

Hydraulic branch line 684 leads to a multi-lance manifold designated generally by the numeral 685 containing a solenoid operated lance water control valve 686 connected in series with a restricter valve 687 with reverse free flow and a relieving sandwich valve 688. A right rotation lance motor hydraulic line 689 leads from relieving sandwich valve 688 to hydraulic motor 712 utilized to extend and retract the cleaning lances. A right rotation lance motor hydraulic line 690 also leads from relieving sandwich valve 688 to motor 712.

Appropriate means such as drain lines 681, 682, 683 and 691 are provided for recycling hydraulic fluid to the tank inlet line 684.

Figure 16:
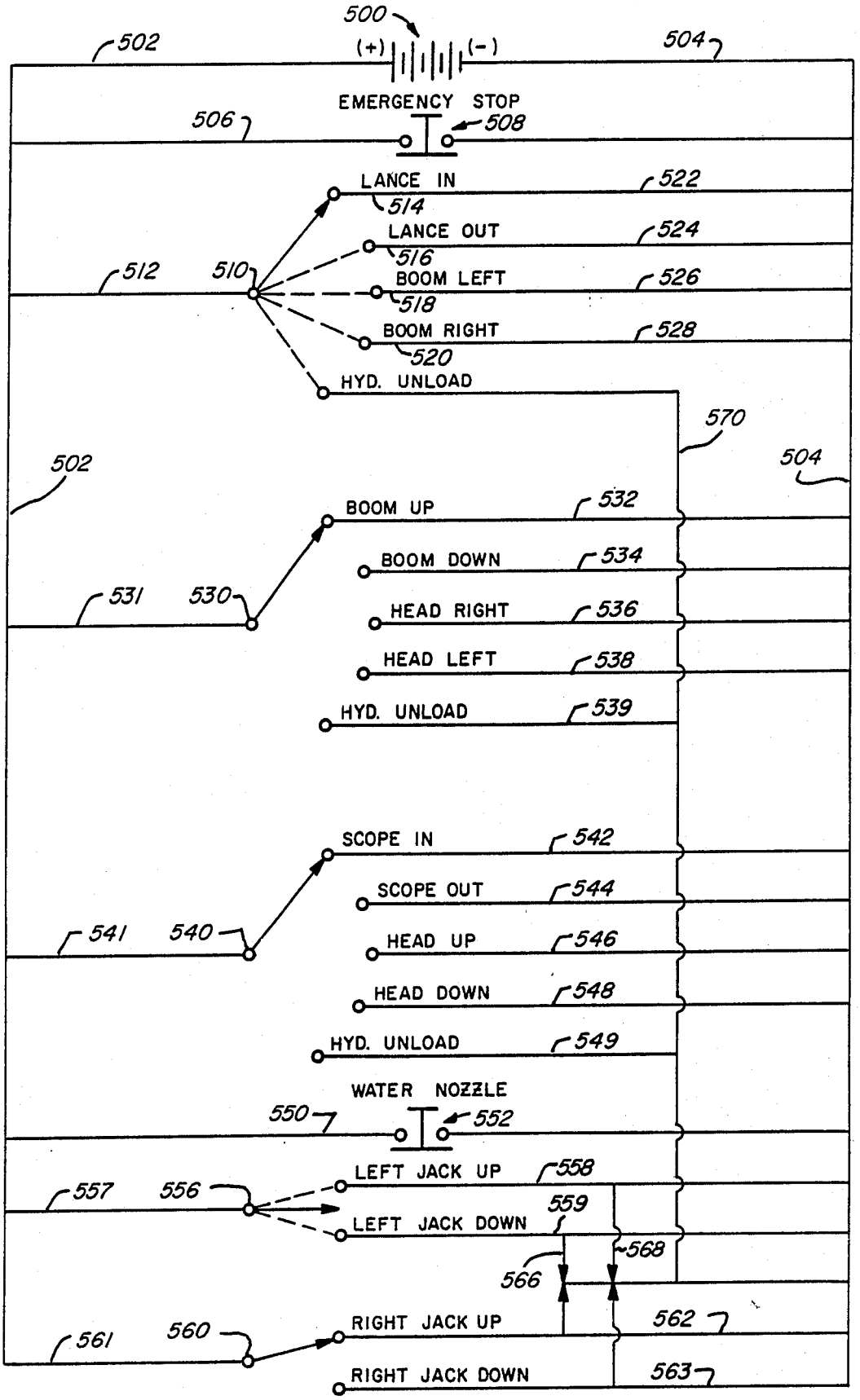
FIG. 16 is a schematic layout of the electrical system of the preferred embodiment of the present invention.

Turning next to FIG. 16 there is schematically shown the principle components of an electrical control system that can be utilized in accordance with the preferred embodiment of the present invention. Again, only the principle components have been schematically shown and conventional elements such as solenoids, switches, rectifiers, fuses, etc., the construction, utilization and operation of which are known to those skilled in the art, have been omitted.

The electrical power system is energized by an appropriate power source such as the battery 500 from the diesel engine 104 (FIG. 1). A trunk line 502 leads from the positive pole of the power source 500 and a trunk line 504 leads from the negative pole of the power source 500. There is preferably provided an emergency bridge line 506 containing an emergency stop switch 508 for killing power to the operating units in the event of an emergency.

A first four-way toggle switch 510 is connected to the trunk line 502 by toggle switch lead line 512 and from lead lines 514, 516, 518 and 520 to the trunk line 504 in order to complete the circuit. The neutral position 529 of the four-way toggle switch 510 may suitably be connected by way of connector 520 with a hydraulic unload lead line 570. In this embodiment, the lead lines 514–516 may be operatively connected with the hydraulic motor 712 for the multi-lance assembly (FIG. 7). Lead line 514 may suitably be connected with the hydraulic motor 712 to retract the lances 704 (FIG. 7) and the lead line 516 may suitably be connected to reverse the direction of rotation of the hydraulic motor 712 in order to extend the lances 704. In like fashion, the lead lines 518–520 may be connected with the hydraulic motor 620 (FIG. 15) used to drive the pinion gear 406 for rotation of the rotary boom gear 404 (FIG. 1). Feed line 518 may suitably be interconnected with the hydraulic motor 620 so as to actuate the motor to rotate the rotary boom gear 404 to the left while lead line 520 may be interconnected with the motor 620 to actuate the motor 620 to turn the rotary boom gear 404 to the right.

In all four of these situations it is desirable to limit the length of travel of the lances 704 and the extend of right or left rotation of the pedestal gear 404 and to this end limit switches 522, 524, 526 and 528 are connected in series with the lines 514, 516, 518 and 520, respectively.

A second four-way toggle switch 530 energized on the switch side by a lead line 531 may also be provided. Again, in the neutral position the toggle switch will interconnect with a hydraulic unload lead line 539 leading to the hydraulic unload line 570. Electrical leads 532 and 534 may be interconnected with the four-way, three-position operating control valve 628 (FIG. 15) for raising and lowering the boom 410 by means of hydraulic cylinder 412 (FIG. 1 and FIG. 15). Lead lines 536 and 538 may be operatively interconnected with the four-way, three-position operating valve 640 to control right and left movement of the articulating head means 801 by means of cylinder 810 (FIG. 5). A third four-way toggle switch 540 energized at the switch side by a lead line 541 may be provided. Again, in the neutral position the toggle switch 549 will interconnect with a hydraulic unload lead line 549 connecting with hydraulic unload line 570. With this construction the leads 542 and 544 may be interconnected with the control valve 656 (FIG. 15) in order to extend and retract the scope by means of scope cylinder 424 (FIG. 15). Lead lines 546 and 548 may be interconnected with operating valve 642 (FIG. 15) in order to regulate upward and downward movement of the articulating head means 800 (FIG. 4). A branch line 550 containing a cut-off switch 552 may be interconnected with the solenoid operated unloading relief valve 608 in order to interrupt the flow of water through the water lines 720 (FIG. 7) of the multi-lance unit 700.

A lead line 557 may interconnect the trunk line 502 with a first two-way switch 556 for controlling vertical movement of the left jack 106 (FIG. 1) mounted on the chassis 100. In this embodiment the leads 558 and 559 will be interconnected with the operating valve 672 (FIG. 15). In like manner a second two-way switch 560 connected with trunk line 502 by a lead line 561 may be provided for regulating up and down movement of the right jack 106. In this situation the leads 562 and 563 are interconnected with the operating valve 673 (FIG. 15).

Bridge line 566 interconnect the leads 559 and 562 while a bridge line 568 interconnects the lead lines 558 and 563 in order to balance the system. The two bridge lines lead to the hydraulic unload line 570 for releasing hydraulic fluid when the two-way valves 556 and 560 are in a neutral position.

In FIG. 20 there is schematically shown in perspective view of the remote control unit that is preferably used in accordance with the present invention. The remote control unit designated generally by the numeral 900 may suitably comprise the emergency stop switch 508, the four-way toggle switches 510, 530 and 540 and the water nozzle switch appropriately mounted in a suitable housing 902. The switches 508, 510, 530, 540 and 552 may appropriately extend through openings in the housing 902. Trunk lines 502 and 504 will lead from the control unit 900 to the tube cleaning unit mounted on the chassis 100.

OPERATIONS

Figure 11:
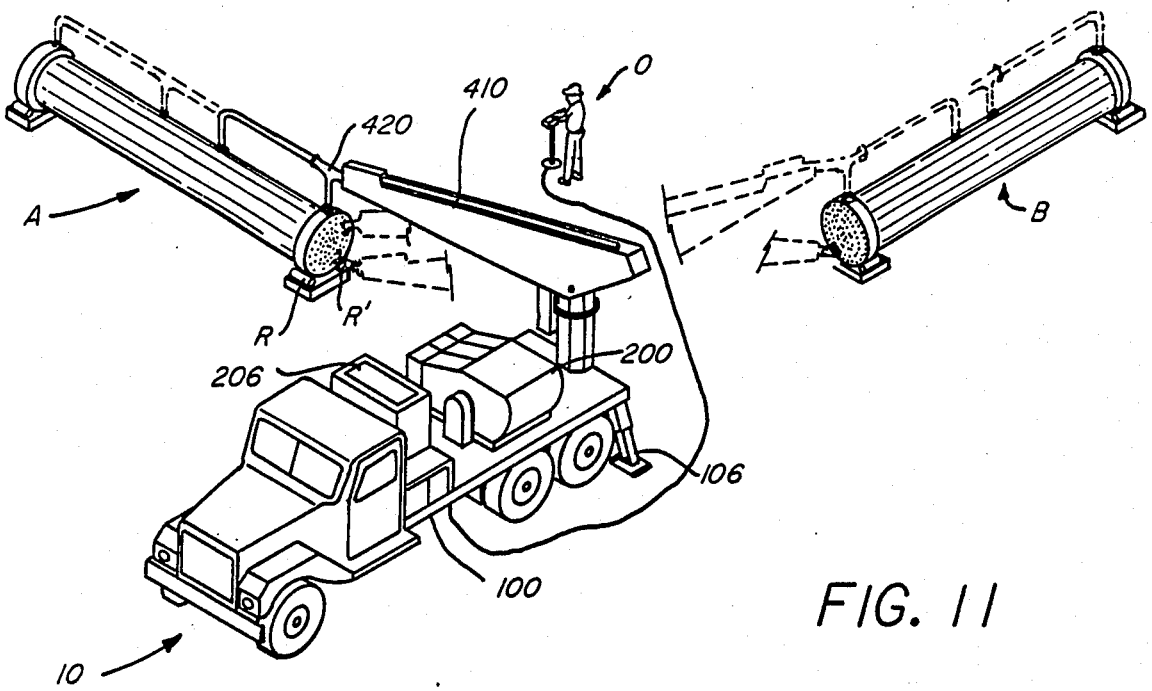
FIG. 11 is a schematic perspective view showing the one manner of operation of the preferred embodiment of the present invention.

The manner of operation of the mobile articulatable tube bundle cleaner of the present invention will be described generally with respect to FIGS. 11, 12, 13 and 14. Turning first to FIG. 11, the mobile base 10 of the mobile articulatable tube bundle cleaner 10 of the present invention may be driven to a suitable location adjacent one or more tube bundles such as tube bundles A and B. When the mobile base 10 is in the proper position, the switches 556 and 560 (FIG. 16) may be interconnected with leads 559 and 563 in order to lower the hydraulic jacks 106 to ground level so as to take at least a portion of the load of the mobile unit 10 so that the chassis 100 will be fixed in an appropriate position. For example, tube bundles A and B may previously have been removed from their location within the shells of a heat exchangers and transported to the cleaning station so that the tube bundle cleaning operation can be conducted without interfering with other operations of the manufacturing unit in which the heat exchangers are normally located. A water line from a suitable source (not shown) will then be connected to the water inlet junction 210 in order to provide water for the cleaning operation. The diesel engine 104 will be operated at a desired predetermined speed and the power from the diesel will be transmitted via gear splitter box 216 to the drive chain 204 to power the variable speed, high volume, high pressure, positive displacement pump 200. As a consequence, water delivered to the water inlet junction 210 will be drawn from thence via water line 209 to water tank 206 and from thence through water inlet line 208 leading to the pump 200.

If it be assumed that the operator O is not yet ready to initiate tube cleaning operations, he will activate the switch 552 (FIG. 16 and FIG. 21) in order to close main cutoff valve 304. The same signal will actuate the control on the recycle valve 303 to initiate the opening of valve 303. Valve 303 will continue to open until the volume of water recycled to tank 206 by line 302 is adequate to maintain a constant head of pressure on water leaving pump 200.

If the operator wishes to clean the shell side tube bundle B first, he may, for example, actuate toggle switch 530 (FIG. 21 and FIG. 16) in order to elevate the boom 410 to a desired height. Actuation of the switch 430 will interconnect the switch with lead 532 leading to boom manifold 624 in order to actuate valves 628 and 629 to initiate flow of hydraulic fluid through hydraulic fluid line 630 leading to boom height hydraulic cylinder 412. This will result in extension of the piston 417 which, pivoting about cylinder support 414 and piston support 418, will cause the boom 410 to be elevated. When the desired elevation is reached, the toggle switch 530 is returned to the neutral position.

Next, for example, the operator O will activate toggle switch 510 so as to interconnect it with electrical lead 518 leading to pedestal manifold 612 in order to activate valves 616 and 618 so as to cause hydraulic fluid to flow through the hydraulic fluid line 619 to hydraulic motor 407 in order to activate pinion gear 406 so as to rotate boom gear 404 to the left to thereby move the boom 410 leftward until it is in alignment with the tube B to be cleaned. At this point the operator would return the toggle switch 510 to its neutral position. In the meantime, an appropriate nozzle assembly such as the nozzle assembly shown in FIG. 17 will have been threaded onto flanged end plate 435 of scope conduit 431 to provide an orifice defined by water jet tips 160 through which water may be jetted.

The operator O would next open switch 552 to initiate flow of a high volume of water under a high pressure such as the pressure of 10,000 pounds per square inch or more through boom delivery pipe 306 to boom hose 308 and thence through scope hose 310 (FIG. 1) to the conduit 431 for the scope 420 (FIG. 3A) at the rate of about 100 gallons per minute or more. The operator would then activate toggle switch 540 in order to interconnect it with electrical lead line 542 (FIG. 16) leading to scope manifold 654 in order to actuate valves 656 and 661 so as to initiate a flow of hydraulic fluid through the hydraulic fluid flow line 662 leading to the scope cylinder 424. Introduction of hydraulic fluid into the scope cylinder 424 will cause the scope extender piston 426 to move outwardly from its position within the piston 424 so as to move the scope 420 outwardly along rollers 422. As a consequence, a high volume jet of high pressure water will emerge through the orifice 160 to impact on the outer surfaces of the tubes in the tube bundle B to hydroblast carbonaceous and/or calcareous deposits therefrom along the path of travel of the scope 420. If the segment of the tube bundle B being impacted and hydroblasted by the jet of water emerging from the orifice 160 does not fully clean that segment of the tube bundle B with the outward pass of the scope 420, the operator can activate the toggle switch 540 so as to interconnect the switch with electrical lead line 544 which, on activation of valves 656 and 661 will cause hydraulic fluid to flow through hydraulic fluid flow line 663 to the piston rod side of the scope cylinder 424 to thereby cause retraction of the piston rod 426 so that the segment of tube bundle B will be subjected to a repeat action on the part of the high pressure, high volume stream of water impacting thereon. This operation can be continued for as many times as is necessary to completely clean the segment of the tube bundle B directly under the path of travel of the scope 420. When the initial segment has been cleaned, the tube bundle B can be rotated about rollers R, R' (FIG. 11) in order to expose another segment of the surface of the tube bundle to the hydroblasting action of the high volume jet of water emerging under high pressure from orifice 160. This sequence of operations can be continued segment by segment until the entire periphery of the tube bundle B and, hence, the entire outer surfaces of the tube bundle B have been hydroblasted to a clean condition. At that point, cleaning operations for tube bundle B can be at least temporarily terminated by activating the switch 552 to again close valve 304 so as to cause water emerging from the pump 200 through line 300 to be recycled back to the tank 206 through line 302. This has the advantage that the pump 200 continues to operate at its desired setting on a continuous basis and without the necessity for continually starting and stopping the pump 200 as cleaning operations progress. This will add significantly to the working life of the pump.

With the flow of water through the orifice 160 terminated, the operator O may next unscrew the tubular connector 150 and replace it with hammer union mate 162 (FIG. 18).

In the meantime, the operator O would have retracted scope 420 by activating toggle switch 540 and adjusted the height of the boom 410 so that it directly faces the end of the tube bundle B by appropriate manipulation of toggle switches 510 and 530. With the orifices 160 now facing the end of the tube bundle B, toggle switch 552 is again activated so as to hydroblast the face of the tube bundle B with a jet of high velocity, high pressure water, as described above, so as to remove carbonaceous and/or calcareous deposits form the face of the tube bundle B.

Next, and with reference to FIGS. 10, 17, 18 and 19, the hammer union mate 162 (FIG. 18) is removed from the spoked hammer member 152 (FIG. 17) and the third hammer union mate 184 (FIGS. 10 and 19) is threaded into the spoked hammer member 152 and the universal joint 186 is attached to the support flange 722 so that the elongate frame 740 of the multi-lance cleaning system can be articulatably suspended from scope 420. With additional reference to FIGS. 13 and 20, the operator O will position the remote control unit 900 at an appropriate safe position which is remote from a tube bundle C, the interiors of the tubes of which are to be cleaned.

With additional reference to FIGS. 1, 1A, 14, 15 and 16, the operator will close switch 552 which is operatively connected to valves 303 and 304 in order to close main cutoff valve 304 and open recycle valve 303 so that water discharged by pump 200 will recycle to tank 206 by way of water recycle line 302. The operator will then horizontally rotate boom 410 by moving the toggle of toggle switch 510 to connect with lead line 518 which is operatively connected with hydraulic motion 407 to turn rotating boom gear 404 and, hence, boom 410 to the left, if he so desires or by connecting toggle switch 510 with lead line 520 if he wants to turn boom 410 to the right. Next, the operator will adjust the vertical height above the ground of the elongate frame 40 of the multi-lance tube cleaning system 700 by moving toggle switch 530 so as to connect with lead line 532 or lead line 534, which are operatively connected with boom height hydraulic cylinder 412 in order to raise or lower the boom 410. The spacing of the tube cleaning lances 704 of the multi-lance tube cleaning system 700 from the face of tube bundle C can be adjusted by moving the toggle of toggle switch 510 to contact lead line 514 or 516 in order to move the scope 420 in or out of the boom 410, as desired. In this manner, the multi-lance tube cleaning system 700 can be brought into parallel alignment with the longitudinal axis of the tube bundle C with the tips of the cleaning lances 704 adjacent the face of the tube bundle C and in close proximity to a plurality of tubes that are to be interiorily cleaned.

Since water under pressure is not being charged to the multi-lance tube cleaning system 700, a second operator can safely approach tube bundle C to check the alignment of the cleaning lances 704 and, by movement of the elongate frame 740 about universal joint 186 make sure that the tips of the lances 704 are in, or will enter the plurality of tubes of tube bundle C that are to be cleaned. The second operator will then move to a safe position and the operator O will open cutoff switch 552 so that a high volume of high pressure water will be delivered to the cleaning lances 704 from pump 200 by way of pump discharge bit 300, boom delivery pipe 306, boom hose 308, scope hoses 310, scope conduit 421 and manifold 180 and then by way of hoses 720 to pressure equalizing means 706 to which the cleaning lances 704 are connected. The operator O will also move the toggle of toggle switch 510 into contact with lead 516 in order to energize hydraulic motor 712 to rotate power gear 710 so that the link chain 716 will move the manifold means 706 which, in turn, will pull drag chain 718 to which it is connected by drag chain mount 726 along slot 708 (FIG. 8) as the lances 704 move into the tubes of tube bundle C with which they are aligned. The water jetting from the tips of the lances 704 will clean the inside of the tubes of fouling deposits as the cleaning lances are moved therethrough.

If the tip of one or more of the cleaning lances 704 should encounter a comparatively "soft" plug, the mechanical force exerted on the plug by powered insertion of the lances 704 by hydraulic motor 712 will normally be sufficient to dislodge it. However, a plug is sometimes lodged so firmly in a tube that it is almost as if the plug were "cemented" in place. When using hand-held lances of the prior art, such plugs are removed dangerously and with difficulty (if they can be removed) or must be mechanically drilled from the tube. However, this problem is essentially resolved with safety when using the multi-lance tube cleaning assembly 700 of the present invention. Thus, the "blocked" cleaning lance will not be overpressured because the manifold means 706 will automatically adjust water flow through the other lances to compensate for the blockage. Also, the operator can move the toggle switch 510 back and forth to alternately connect with leads 514 and 516 to move the lances 704 backwards and forwards in the tubes so as to "hammer away" at the plug until it is dislodged. Again, pressure equalization by the manifold means 706 will prevent overpressuring of either the lance or the tube.

When the selected plurality of tubes of tube bundle C have been cleaned in the described manner, the toggle switch 510 is connected with lead 514 to move the lances 704 out of the cleaned tubes, the water cutoff switch 552 is closed so that water no longer flows to the lances 704, and the lances 704 can then be repositioned in the described manner in order to clean a next selected plurality of tubes. The operation continues in this manner until all of the tubes of tube bundle C have been cleaned.

Figure 12:
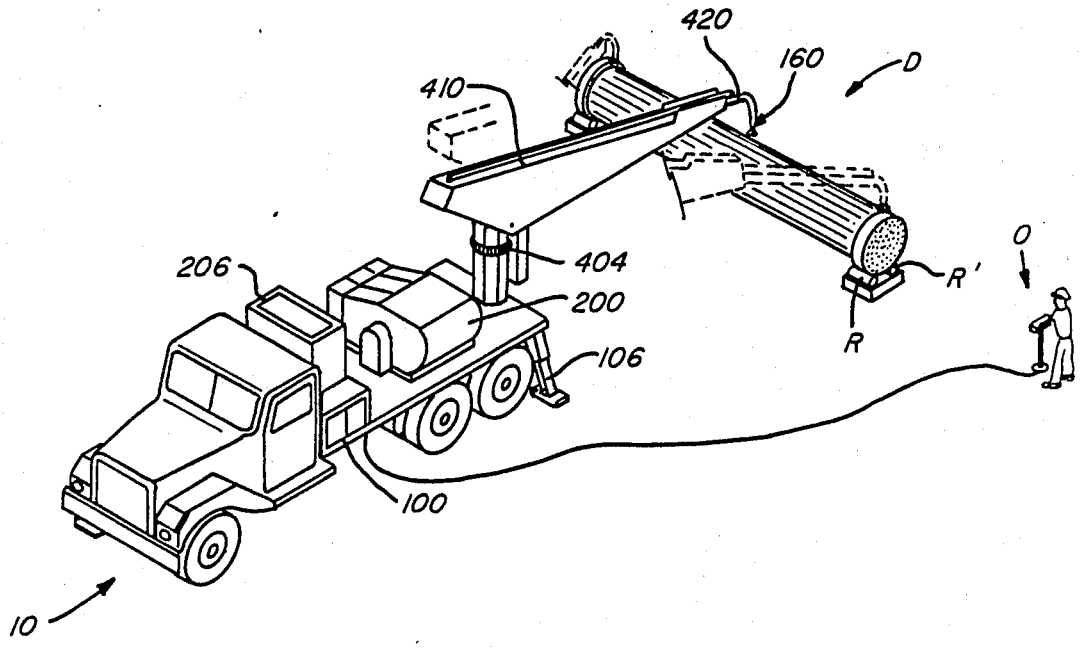
FIG. 12 is a schematic perspective view showing another mode of operation of the present invention.
Figure 13:
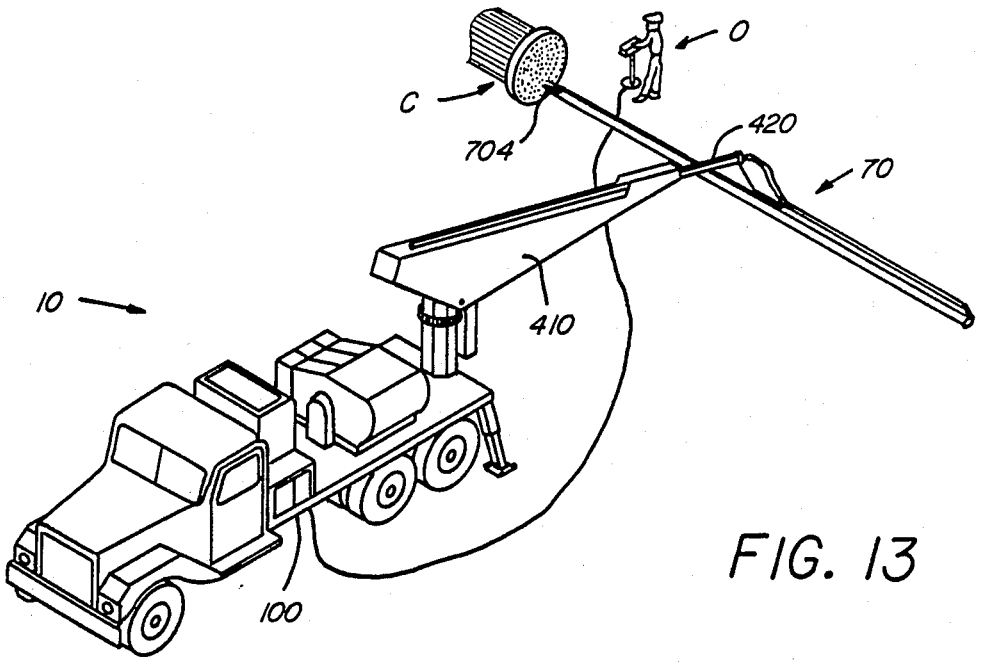
FIG. 13 is yet a third schematic perspective view of a third mode of operation of the present invention.

With particular reference to FIG. 12, another mode of cleaning the exterior surfaces of a tube bundle D is shown wherein the tube bundle D is transversely mounted on rollers R and R' transversely of the axis of truck chassis 100. With this mode of operation, the cleaning of each segment of the exterior of the tube bundle D, is accomplished using the pipe 160 (FIG. 18) at the end of the scope 420. The boom 410 is rotated back and forth by activation of the boom gear 404 and extension and/or retraction of the scope 420, as needed. After the exterior surfaces of the tube bundles have been cleaned, the boom 410 can be further rotated and, by use of the articulatable head aligning means 800, used to clean both of the end faces of the tube bundle D without a need for moving either the tube bundle D or the truck chassis 100.

In like fashion, the interiors of the tubes in the tube bundle D can be cleaned using the multi-lance tube cleaning system 70 in the manner described above. The mode of operation of FIG. 12 is thus very advantageous when the total length of the tube bundle D is such that articulation of the boom 410 to the right, to the left and up and down can permit all of the exterior and interior surfaces to be cleaned while the tube bundle D is in one location. However, when the tube bundles, such as tube bundles A and B are of a length such that the boom and scope cannot be articulated to an arc wide enough to permit cleaning of both faces, then the arrangement of FIG. 11 is preferred.

Figure 14:
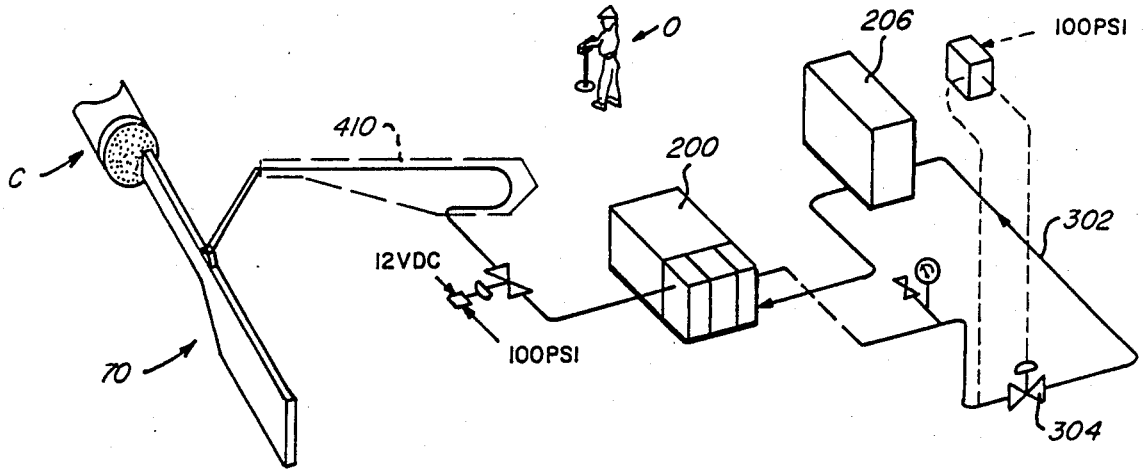
FIG. 14 is a schematic perspective view of the hydraulic system used in the operation of the multi-lance system.

With particular reference to FIG. 14, there is a schematic illustration of the advantageous use of the pressure control valve 304 during a cleaning operation. In lance cleaning operations for the interior of tube bundles, frequent interruption of water flow through the boom 420 and the lance system 70 is necessary. However, it is not necessary to interrupt the operation of the pump 200, because the operator, on activation of the switch 552 will close the main cutoff valve 304 and open the recycle valve 303 so that water recycles back to the pump 200 through water recycle line 302 to tank 206 while the pump is operating at its desired predetermined load level.

As illustrated by the foregoing description of a preferred embodiment of the present invention, the tube bundle cleaner of the present invention comprises a mobile base, water pressuring means, articulatable water delivery means, channelled articulatable support means, water discharge means, and remotely actuatable control means interconnected with the articulatable support means, water pressuring means, and the water delivery means.

The mobile base may comprise a conventional truck chassis 100 of any suitable construction, such as the nine wheel chassis of a tractor-trailer combination appropriately mounted on wheels 102 for movement, and powered by a diesel engine 104 of any conventional construction. A pair of hydraulically powered stabilizing jacks 106 mounted to the chassis 100 at the rear thereof for downward extension are provided to stabilize the mobile base against movement when the unit 10 is in a desired location.

The water pressuring means may suitably comprise for example, a variable speed, high volume, high pressure, positive displacement pump 200. A gear splitter box 216 provides appropriate means for powering a pump drive chain 204 connected with the pump drive shaft 202 for driving the pump 200. A water tank 206 mounted on the chassis 100, preferably adjacent the cab of the truck receives water from a pipe connected to an extraneous water source leading to a water inlet junction 210 mounted on chassis 100 and from thence to water tank 206. Water line 208 leads from water tank 206 to the suction side of pump 200.

The water delivery means of the preferred embodiment of the present invention will appropriately comprise a pump discharge line 300 containing a main cutoff valve 304 which may suitably be a pneumatically powered remotely controlled shut-off valve of any conventional construction. The pump discharge line 300 leads to a boom delivery pipe 306 which, in turn, leads to a boom hose 308 which is in turn connected to a scope conduit 310.

The channeled vertically and horizontally movable support means of the present invention, may suitably comprise a boom pedestal 402, a boom rotating gear 404, a power driven pinion gear 406 for rotating the boom 410 in a horizontal direction and a boom support 408 on which a channeled boom 410 is mounted. A boom height control cylinder 412 is mounted on a boom cylinder support 414 and the piston 417 of the boom height control cylinder 412 is connected at its outer end with a pivotal boom piston support 418. A channeled scope 420 is mounted on top of the boom 410. Extension of the scope 426 on rollers 422 is controlled by a scope cylinder 424 mounted on the scope 420 and a scope extender piston 426 extending from the cylinder 424 and mounted to the free end of the scope 420 so that the piston 426 may be extended from the cylinder 424 to thereby extend the scope 420.

The water discharge means of the present invention may suitably comprise, for example, nozzle adapter 140 which may be fixed to the end plate 435 of the scope discharge port 433. A tubular connector 150 fitted to the nozzle adapter 140 interconnects with an appropriate nozzle assembly such as plug 158 fitted with water jet tips 160 (FIG. 17), an elbow joint 166 similarly fitted with a plug 158 into which one or more water jet tips 160 are inserted (FIG. 18) or a manifold 180 (FIG. 19) which can be interconnected with the plurality of tube cleaning lances 704 in the manner described above.

The control means may comprise, for example, a hydraulic pump 600 connected on the suction side to a hydraulic fluid holding tank 602 by a pump inlet line 604. A hydraulic pump outlet line 606 passes from the hydraulic pump 600 through a solenoid operated relief valve 608 to a pedestal manifold 612. A relief valve recycle line 610 returns to the tank 602 for discharging fluid thereto in the event of an emergency cut off of hydraulic fluid flow by the relief valve 608.

The control means also includes scope manifold 654 which is suitably provided with branch lines 662 and 663 for extending and retracting the scope, a hydraulic jack manifold 664 from which branch hydraulic lines 674, 676, 678 and 680 lead for raising and lowering the hydraulic jacks 106—106; a boom manifold 624 from which branch hydraulic fluid lines 630 and 632 lead for raising and lowering boom 410; and a manifold 634 from which branch hydraulic fluid lines 650, 651, 652 and 653 lead for operating the articulatable head aligning means 800.

The equipment of the present invention is much safer to operate since the pressure lines are all enclosed and are not directly contacted by operators during cleaning operations. This highly desirable safety feature also makes possible the provision of the delivery of significantly larger volumes of water at significantly higher pressures from the nozzles for cleaning tube bundles.

Another advantage shown by this example lies not to much in the very significant savings in man-hours required for the cleaning job as in the significant reduction of cleaning time, meaning that the plant from which the tube bundles were taken for cleaning could be returned to operating service in a significantly shorter period of time.

By way of specific example, operating only one eight-hour shift per day, a three man crew operating the apparatus of the present invention cleaned sixteen tube bundles with about 264 man-hours of labor.

To accomplish this same cleaning result using conventional hydroblasting technology with hand operated tube lances and tube lance guns would have required at least eight operators using three machines and would have required an estimated 960 man-hours of labor. Thus, with the use of the present invention, a crew of three men was able to clean the sixteen bundles with an average of 16.5 man-hours of labor whereas it would have required an average of about 60 man-hours of labor to have cleaned the same number of bundles using conventional hydroblasting technology.

Having thus described the invention, what is claimed is:

1. Multi-lance cleaning means for use in cleaning tubes of a tube bundle including:

an elongate chambered frame having an elongate channeled lance housing extending along the top thereof;

a hollow manifold block slidably mounted in said lance housing;

a plurality of tube cleaning lances slidably longitudinally positioned in said lance housing, fluidly connected at their rear ends to the hollow of said manifold block and longitudinally alignable with a corresponding plurality of tubes of a tube bundle, the interiors of which are to be cleaned;

a plurality of flexible water hoses connectable with a pressured water supply means extending into the chamber of said elongate chambered frame and fluidly interconnected with the hollow of said manifold block;

a drag chain mounted in said chamber of said elongate frame and connected at its free end with said manifold block, said plurality of hoses being nested in said drag chain;

hydraulically actuatable power means operably connected with said drag chain for independently moving the same in response to hydraulic pressure; and remotely actuatable control means operably connected with said power means for moving said drag chain in response to a signal to thereby simultaneously move said cleaning lances in response to movement of said drag chain.

2. Multi-lance cleaning means as in claim 1 wherein: said elongate chambered frame comprises:

a rear stock segment and a front barrel segment; and a plurality of idler gears mounted in said stock segment and said barrel segment;

said hydraulically actuatable power means comprises hydraulic power means mounted in said stock segment adjacent the front end thereof;

said hydraulic drag chain moving means comprises:

a power gear mounted in said stock segment operatively connected with said hydraulic power means; and endless chain means mounted in said stock segment and said barrel segment in guided engagement with said idler rollers, in driven engagement with said power gear and in driving engagement with said drag chain.

3. Multi-lance cleaning means as in claim 2 wherein:

a perforate guide plate is fixed to the front end of said barrel segment with said cleaning lances extending therethrough;

a guide tube is mounted on the outside of said guide plate about each extending cleaning lance.

4. Multi-lance leaning means as in claim 3 wherein said flexible hoses are capable of containing water pressured at about 10,000 to about 15,000 psi.

5. In combination, an upstanding base and a multi-lance tube cleaner:

said upstanding base comprising a boom;

articulatable support means depending from the end of said boom and interconnecting the end of said boom with said multi-lance tube cleaner adjacent the mid point thereof for wholly supporting said multi-lance cleaner above the ground;

said multi-lance tube cleaner comprising:

an elongate chambered frame having an elongate channeled lance housing extending along the top thereof;

a hollow manifold block slidably mounted in said lance housing;

a plurality of tube cleaning lances slidably longitudinally positioned in said lance housing and connected at their rear ends to said manifold block in fluid communication with the hollow therein and longitudinally alignable with a corresponding plurality of tubes of a tube bundle, the interiors of which are to be cleaned;

a plurality of flexible water hoses fluidly interconnected with a source of pressure water extending into the chamber of said elongate chambered frame and fluidly interconnected with the hollow of said manifold block, whereby the pressure of incoming water will be equalized in the hollow of said manifold block before flowing through said tube cleaning lances;

endless chain means mounted in said chamber of said elongate frame;

a drag chain mounted in said chamber of said elongate frame, said drag chain being connected at one end thereof with said manifold block and at the other end thereof with said endless chain means, said plurality of hoses being nested in said drag chain;

fluidly actuatable endless chain power means mounted in said elongate chamber and operably connected with said endless chain means whereby movement of said endless chain means by said power means will correspondingly move said drag chain, said hollow manifold and said cleaning lances; and remotely actuatable control means operably connected with said power means for activating the same.

6. A combination as in claim 5 wherein said depending support means comprises:

a hollow vertical nippled body portion;

connecting means at the top of said body portion for supporting said body portion from the end of said boom and for fluidly connecting said hollow of said body portion with a source of pressured water; and a universal joint on the bottom of said body portion interconnected with said multi-lance tube cleaner;

said nipples of said body portion being fluidly connected with said flexible water hoses of said multi-lance cleaner.

7. A combination as in claim 6 wherein said multi-lance tube cleaner:

said elongate chambered frame comprises a rear hollow stock segment and a front hollow barrel segment;

said power means is mounted inside said stock segment adjacent the front end thereof;

a plurality of idler rollers are mounted inside said stock segment and said barrel segment in guiding engagement with said endless chain means; and said drag chain is mounted inside said stock segment.

8. A combination as in claim 7 wherein said power means comprises a hydraulic motor and a power gear rotatably mounted in said stock segment and operatively interconnecting said hydraulic motor with said endless chain means for moving said endless chain means in response to a signal from said remote control means.

9. A combination as in claim 8 wherein said multilance tube cleaner also includes:

a perforate guide plate fixed to the front end of said barrel segment with said cleaning lances extending therethrough; and a guide tube mounted on the outside of said guide plate about each extending cleaning lance.

10. A combination as in claim 9 wherein said hoses are capable of containing water at a pressure of about 10,000 to about 15,000 psi.

* * * * *